US007647784B2

(12) United States Patent
Mizutani et al.

(10) Patent No.: US 7,647,784 B2
(45) **Date of Patent: *Jan. 19, 2010**

(54) REFRIGERATION DEVICE AND METHOD FOR DETECTING REFRIGERANT AMOUNT OF REFRIGERATION DEVICE

(75) Inventors: Kazuhide Mizutani, Sakai (JP); Hiromune Matsuoka, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/022,801

(22) Filed: Jan. 30, 2008

(65) Prior Publication Data

US 2008/0134700 A1 Jun. 12, 2008

Related U.S. Application Data

(63) Continuation of application No. 10/512,678, filed as application No. PCT/JP03/016490 on Dec. 22, 2003.

(30) Foreign Application Priority Data

Jan. 10, 2003 (JP) ..... 2003-003880

(51) Int. Cl.
*G01K 13/00* (2006.01)
*F25B 49/00* (2006.01)
*F25B 39/04* (2006.01)

(52) U.S. Cl. ..... 62/129; 62/131; 62/509

(58) Field of Classification Search ..... 62/129, 62/131, 197, 419, 509, 513
See application file for complete search history.

(56) References Cited

U.S. PATENT DOCUMENTS

| | | | |
|---|---|---|---|
| 5,435,145 | A | 7/1995 | Jaster |
| 5,966,947 | A | 10/1999 | Kamimura et al. |
| 6,405,559 | B1 | 6/2002 | Yoneda |
| 2002/0184898 | A1 | 12/2002 | Chen |

FOREIGN PATENT DOCUMENTS

| | | | |
|---|---|---|---|
| EP | 1033541 | A1 | 9/2000 |
| JP | 06-201234 | A | 7/1994 |
| JP | 09-113078 | A | 5/1997 |
| JP | 11-118266 | A | 4/1999 |
| JP | 11-182990 | A | 7/1999 |
| JP | 2001-027460 | A | 1/2001 |
| JP | 2002-61966 | A | 2/2002 |
| JP | 2002-286333 | A | 10/2002 |
| JP | 2002-350014 | A | 12/2002 |
| WO | WO-99/26028 | A1 | 5/1999 |

*Primary Examiner*—Marc E Norman
(74) *Attorney, Agent, or Firm*—Global IP Counselors

(57) ABSTRACT

An air conditioner includes a main refrigerant circuit and a liquid level detection circuit. The main refrigerant circuit includes a compressor that compresses gas refrigerant, a heat source side heat exchanger, a receiver that stores liquid refrigerant, and user side heat exchangers. The liquid level detection circuit is arranged so as to be capable of drawing out a portion of the refrigerant in the receiver from a first predetermined position of the receiver, reducing the pressure of the refrigerant and heating it, measuring the temperature of the refrigerant, and then returning the refrigerant to the intake side of the compressor, in order to detect whether the liquid level in the receiver is at the first predetermined position.

6 Claims, 15 Drawing Sheets

REFRIGERATION DEVICE AND METHOD FOR DETECTING REFRIGERANT AMOUNT OF REFRIGERATION DEVICE

CROSS-REFERENCE TO RELATED APPLICATIONS

This application is a continuation application of U.S. patent application Ser. No. 10/512,678 filed on Oct. 27, 2004, which is a National phase filing of PCT/JP2003/016490. The entire disclosures of U.S. patent application Ser. No. 10/512,678 and PCT/JP2003/016490 are hereby incorporated herein by reference.

FIELD OF THE INVENTION

The present invention relates to a refrigeration device and a method for detecting the refrigerant amount of a refrigeration device. More particularly, the present invention relates to a refrigeration device that includes a refrigerant circuit having a compressor that compresses gas refrigerant and a receiver that stores liquid refrigerant, and a method of detecting the refrigerant amount of a refrigerant device.

BACKGROUND OF RELATED ART

One example of a conventional refrigeration device that includes a vapor compression refrigeration circuit is an air conditioner that is employed to provide air conditioning for buildings or the like. This type of air conditioner primarily includes a heat source unit having a compressor and a heat source side heat exchanger, a plurality of user units having user side heat exchangers, and gas refrigerant connection lines and liquid refrigerant connection lines that connect these units.

With this air conditioner, each unit and the lines will be installed on site, and then during a test operation, the air conditioner will be charged with the amount of refrigerant needed in accordance with the length of the refrigerant connection lines. When this occurs, the decision as to whether or not the air conditioner has been charged with the required amount of refrigerant will be determined based upon the time needed for charging on site. This is because the length of the refrigerant connection lines will vary due to the site at which the air conditioner is installed. Because of this, the amount of refrigerant charged into the air conditioner must rely upon the charging task level.

One air conditioner that can solve this problem is a device which has a configuration that can detect when the liquid refrigerant stored inside a receiver provided in a refrigerant circuit reaches a predetermined liquid level, and can detect during refrigerant charging the amount of refrigerant that needs to be charged into the air conditioner. An air conditioner 901 having a configuration that can detect the liquid level of a receiver will be described below with reference to FIG. 10.

The air conditioner 901 includes a heat source unit 902, a plurality of (here, two) user units 5 that are connected in parallel, and a liquid refrigerant connection line 6 and a gas refrigerant connection line 7 that serve to connect the heat source unit 902 and the user units 5.

The user units 5 primarily include a user side expansion valve 51, and a user side heat exchanger 52. The user side expansion valve 51 is an electric expansion valve that is connected to the liquid side of the user side heat exchanger 52, and serves to adjust the refrigerant pressure, refrigerant flow rate and the like. The user side heat exchanger 52 is a cross fin tube type heat exchanger, and serves to exchange heat with indoor air. In the present embodiment, a user unit 5 includes a fan not shown in the figures) that takes in indoor air into the interior thereof, and serves to blow air outward, and is capable of exchanging heat between the indoor air and the refrigerant that flows in the user side heat exchanger 52.

The heat source unit 902 primarily includes a compressor 21, an oil separator 22, a four way switching value 23, a heat source side heat exchanger 24, a bridge circuit 25 that includes a heat source side expansion valve 25*a*, a receiver 26, a liquid side gate valve 27, and a gas side gate valve 28. The compressor 21 serves to compress refrigerant gas drawn therein. The oil separator 22 is arranged on the discharge side of the compressor 21, and is a vessel that serves to separate oil included in the refrigerant gas that has been compressed/discharged. The oil separated in the oil separator 22 is returned to the intake side of the compressor 21 via an oil return line 22*a*. The four way switching valve 23 serves to switch the direction of the refrigerant flow during switching between cooling operations and heating operations. During cooling operations, the four way switching valve 23 can connect the discharge port of the oil separator 22 and the gas side of the heat source side heat exchanger 24, and can connect the intake side of the compressor 21 and the gas refrigerant connection line 7. During heating operations, the four way switching valve 23 can connect the outlet of the oil separator 22 and the gas refrigerant connection line 7, and can connect the intake side of the compressor 21 and the gas side of the heat source side heat exchanger 24. The heat source side heat exchanger 24 is a cross fin tube type heat exchanger, and serves to exchange heat between air and refrigerant that acts as a heat source. The heat source unit 902 includes a fan (not shown in the figures) that takes in outdoor air into the interior thereof, and serves to blow air outward, and is capable of exchanging heat between the outdoor air and the refrigerant that flows in the heat source side heat exchanger 24.

The receiver 26 is, for example, a vertical type cylindrical vessel such as that shown in FIG. 11, and serves to temporarily store refrigerant liquid that flows in the main refrigerant circuit 10. The receiver 26 includes an intake port on the upper portion of the vessel, and a discharge port on the lower portion of the vessel. The bridge circuit 25 is formed from the heat source side expansion valve 25*a* and three check valves 25*b*, 25*c*, 25*d*, and serves to allow refrigerant to flow into the receiver 26 from the intake port of the receiver 26 and allow liquid refrigerant to flow out from the discharge port of the receiver 26, even when the refrigerant that flows in the main refrigerant circuit 10 flows into the receiver 26 from the heat source side heat exchanger 24 or flows into the receiver 26 from the user side heat exchangers 52. The heat source side expansion valve 25*a* is an electric expansion valve that is connected to the liquid side of the heat source side heat exchanger 24, and serves to adjust the refrigerant pressure, refrigerant flow rate and the like. The liquid side gate valve 27 and the gas side gate valve 28 are respectively connected to the liquid refrigerant connection line 6 and the gas refrigerant connection line 7. The main refrigerant circuit 10 of the air conditioner 901 is formed by these devices, lines, and valves.

Furthermore, the air conditioner 901 includes a liquid level detection circuit 930 that is connected to a predetermined position on the receiver 26. The liquid level detection circuit 930 is connected between the predetermined position of the receiver 26 and the intake side of the compressor 21, and can draw out refrigerant from the predetermined position of the receiver 26, reduce the pressure of the refrigerant, and return the refrigerant to the intake side of the compressor 21. Here, the predetermined position of the receiver 26 to which the liquid level detection circuit 930 is connected is a first predetermined position $L_1$ (see FIG. 11) that corresponds to the amount of liquid refrigerant that is stored in the receiver 26 when the required amount of refrigerant is charged in the main refrigerant circuit 10. The liquid level detection circuit 930 includes a bypass circuit 931 having an open/close mechanism 931*a* composed of a solenoid valve and a pressure reduction mechanism 931*b* composed of a capillary tube that serves to reduce the pressure of refrigerant that is provided on the downstream side of the open/close mechanism 931*a*, and a temperature detection mechanism 932 composed of a thermistor that is arranged at a position on the downstream side of the pressure reduction mechanism 931*b*.

The act of charging the main refrigerant circuit 10 of the aforementioned air conditioner 901 (which includes the receiver 26 and the liquid level detection circuit 930) with refrigerant (e.g., R407C) will be described.

First, the circuit configuration of the main refrigerant circuit 10 will be placed into cooling operation mode. During cooling operations, the four way switching valve 23 is in the state shown by the solid lines in FIG. 10, i.e., the discharge side of the compressor 21 is connected to the gas side of the heat source side heat exchanger 24, and the intake side of the compressor 21 is connected to the gas side of the user side heat exchangers 52. In addition, the liquid side gate valve 27, the gas side gate valve 28, and the heat source side expansion valve 25*a* are opened, and the aperture of the user side expansion valve 51 is adjusted so as to reduce the pressure of the refrigerant.

With the main refrigerant circuit 10 in this state, refrigerant will be charged into the main refrigerant circuit 10 from the exterior thereof, and a cooling operation will be performed. More specifically, when the heat source unit 902 fan, the user unit 5 fan, and the compressor 21 are actuated, gas refrigerant at a pressure $P_s$ (about 0.6 MPa) (see point A in FIG. 12) will be taken into the compressor 21 and compressed to a pressure $P_d$ (about 2.0 MPa, corresponding to a condensation temperature of 50° C. for the refrigerant in the heat source side heat exchanger 24). After this, the refrigerant will be sent to the oil separator 22 to separate the gas refrigerant and the oil (see point B in FIG. 12). After that, the compressed gas refrigerant is sent to the heat source side heat exchanger 24 via the four way switching valve 23, exchanges heat with outdoor air, and is condensed (see point C in FIG. 12). The condensed liquid refrigerant will be sent to the user units 5 via the bridge circuit 25 and the liquid refrigerant connection line 6. Then, the liquid refrigerant that is sent to the user units 5 is reduced in pressure by the user side expansion valve 51 (see point D in FIG. 12), and then exchanges heat with indoor air in the user side heat exchangers 52 and evaporated (see point A in FIG. 12). The evaporated gas refrigerant is again taken into the compressor 21 via the gas refrigerant connection line 7 and the four way switching valve 23. The same operation as the cooling operation is then performed.

Refrigerant will be charged into the main refrigerant circuit 10 while continuing this operation. Here, by controlling the flow rate of air blown by the fans of each unit 5, 902, only a portion of the total amount of refrigerant that is charged from the outside will be gradually stored as liquid refrigerant in the receiver 26, because the amount of evaporated refrigerant in the user side heat exchangers 52 will be balanced with the amount of condensed refrigerant in the heat source side heat exchanger 24.

Next, while the aforementioned refrigerant charging operation is performed, the open/close mechanism 931*a* of the liquid level detection circuit 930 will be open, a portion of the refrigerant will be drawn out from the first predetermined position $L_1$ of the receiver 26, the pressure thereof will be reduced by means of the pressure reduction mechanism 931*b*, the temperature of the refrigerant after pressure reduction will be measured by means of the temperature detection mechanism 32, and then the refrigerant will be returned to the intake side of the compressor 21.

In the event that the amount of the liquid refrigerant stored in the receiver 26 is low, and the liquid level of the liquid refrigerant does not reach the first predetermined position $L_1$ of the receiver 26, gas refrigerant in the saturated state (see point E of FIG. 13) will flow therein. This gas refrigerant will be reduced in pressure to pressure $P_s$ by the pressure reduction mechanism 931*b*, and reduced in temperature from about 57° C. to about 20° C. (a temperature reduction of about 37° C.)(see point F of FIG. 13).

After this, when the liquid level of the liquid refrigerant reaches the first predetermined position $L_1$ of the receiver 26 and liquid refrigerant in the saturated state in the receiver 26 flows into the liquid level detection circuit 930 (see point H of FIG. 13), by reducing the pressure of this liquid refrigerant to pressure $P_s$ by means of the pressure reduction mechanism 931*b*, the temperature of the refrigerant will rapidly reduce from about 50° C. to about 3° C. (a temperature reduction of about 47° C.)(see point I of FIG. 13) due to the occurrence of flash evaporation.

Thus, in this air conditioner 901, a liquid level detection circuit 930 is provided which takes a portion of refrigerant out from the first predetermined position $L_1$ of the receiver 26, reduces the pressure thereof, measures the refrigerant temperature, and then returns the refrigerant to the intake side of the compressor 21. Then, if the refrigerant taken out from the receiver 26 is in the gas state, the liquid level detection circuit 930 will reduce the temperature of the refrigerant reduced in pressure in the liquid level detection circuit 930 a small amount (from point E to point F of FIG. 13), and if the refrigerant taken out from the receiver 26 is in the liquid state, the liquid level detection circuit 930 will reduce the temperature of the refrigerant reduced in pressure by means of flash evaporation a large amount (from point H to point I of FIG. 13). If this temperature reduction is large, the liquid level detection circuit 930 will determine that the liquid refrigerant in the receiver 26 is stored up to the first predetermined position $L_1$, and if this temperature reduction is small, the liquid level detection circuit 930 will detect that the required amount of refrigerant has been charged into the main refrigerant circuit 10 by determining that the liquid refrigerant in the receiver 26 has not been stored up to the first predetermined position $L_1$. (e.g., refer to Japanese Patent Unexamined Publication No. 2002-350014)

However, there will be times in which the aforementioned conventional air conditioner 901 must be operated under conditions in which the temperature of the heat source (such as the outside air) of the heat source side heat exchanger 24 is high, and the refrigerant pressure on the discharge side of the compressor 21 is high. In addition, there will be times in which the operating refrigerant will be changed from R407C to R410A or the like having saturation pressure characteristics (i.e., a low boiling point) that are higher in pressure than R407C, R22, or the like.

For example, as shown in FIG. 14, when the operating refrigerant is changed to R410A, because the boiling point of R410A is lower than that of R407C, the condensation temperature of the refrigerant in the heat source side heat exchanger 24 during cooling operations is assumed to be the same 50° C. as when R407C is used, and the condensation pressure in the heat source side heat exchanger 24, i.e., the discharge pressure $P_d'$ of the compressor 21, is assumed to be about 3.0 MPa. Under these conditions, if the refrigeration cycle during cooling operations is drawn in FIG. 14, a line will connect points A', B', C' and D'. Here, the point one must pay attention to is the inclination of the vapor line at point E' at which the line segment B'-C' intersects with the vapor line. As shown in FIGS. 12 and 13, when R407C is used as the operating refrigerant, the inclination of the vapor line at point E at which the line segment B-C intersects with the vapor line is approximately vertical with respect to the horizontal axis or inclined slightly to the right in the figures. However, as shown in FIG. 14, when R410A is used, the inclination of the vapor line at point E' at which the line segment B'-C' intersects with the vapor line is inclined to the left. Because of this, if one attempts to detect whether or not the refrigerant stored in the receiver 26 has reached a predetermined position by means of the liquid level detection circuit 930, then as shown in FIG. 13, if R407C is used the degree of temperature reduction when gas refrigerant in the saturated state is reduced in pressure (from point E to point F of FIG. 13) will be smaller than the degree of temperature reduction when liquid refrigerant in the saturated state is reduced in pressure (from point H to point I of FIG. 13). However, as shown in FIG. 15, if R410A is used, in order achieve the two-phase state when gas refrigerant in a saturated state is reduced in pressure (point E' to point F' of FIG. 15), the same temperature reduction will be produced as when flash evaporation occurs if liquid refrigerant in the saturated state is reduced in pressure (from point H' to point I' in FIG. 15). Note that with either refrigerant, a temperature reduction of about 47° C. (from 50° C. to 3° C.) will occur.

Because of this, even if the liquid level of the liquid refrigerant does not reach the first predetermined position $L_1$ of the receiver 26, the sudden reduction in the temperature of the refrigerant taken from the first predetermined position $L_1$ of the receiver 26 will be detected, and errors will occur in the determination of whether the liquid refrigerant is stored up to the first predetermined position $L_1$ of the receiver 26.

In addition, this phenomenon is not limited only to situations in which the operating refrigerant is R410A. Even in situations in which R407C is used, the same phenomenon as with R410A will be produced if operations occur under conditions in which the outdoor air temperature is high and the condensation temperature of the refrigerant in the heat source side heat exchanger 24 is high, because the position of point E in FIGS. 12 and 13 will shift upward, and the inclination of the vapor phase will move leftward.

SUMMARY OF THE INVENTION

In a refrigeration device including a refrigeration circuit having a compressor and a receiver, an object of the present invention is to increase the ability of a liquid level detection circuit to accurately determine whether or not liquid refrigerant is stored up to a predetermined position of the receiver.

In accordance with a first aspect of the invention, the refrigeration device includes a main refrigerant circuit and a liquid level detection circuit. The main refrigerant circuit includes a compressor that compresses gas refrigerant, a heat source side heat exchanger, a receiver that stores liquid refrigerant, and user side heat exchangers. The liquid level detection circuit is arranged so as to be capable of drawing out a portion of the refrigerant in the receiver from a predetermined position of the receiver, reducing the pressure of the refrigerant and heating it, measuring the temperature of the refrigerant, and then returning the refrigerant to the intake side of the compressor, in order to detect whether the liquid level in the receiver is at the predetermined position.

This refrigeration device includes a liquid level detection circuit that is capable of measuring the temperature of refrigerant drawn out from a predetermined position of the receiver after pressure reduction and heating. With this arrangement, because there will be a large increase in the temperature of the refrigerant due to heating when the refrigerant drawn out from the receiver is in the gas state, and when in the liquid state, the heat energy due to heating will be consumed as latent heat of vaporization and thus there will be a small increase in the temperature of the refrigerant due to heating, the liquid level detection circuit can determine that the liquid refrigerant is not stored up to the predetermined position of the receiver when there is a large increase in refrigerant temperature, and can determine that the liquid refrigerant is stored up to the predetermined position of the receiver when there is a small increase in refrigerant temperature. Thus, even under conditions in which the refrigerant drawn out from the receiver is in the saturated gas state, and a two-phase state is produced during pressure reduction, because the liquid level detection circuit can determine whether or not liquid refrigerant is stored up to the predetermined position of the receiver, the determination accuracy thereof can be improved compared to when a conventional liquid level detection circuit is used to determine whether or not refrigerant is stored up to the predetermined position of the receiver by means of the size of the temperature reduction during pressure reduction.

In accordance with a second aspect of the invention, the refrigeration device in which the predetermined position of the receiver is a position at which gas refrigerant or liquid refrigerant can be present when the amount of refrigerant stored in the receiver has changed.

In accordance with a third aspect of the invention, the refrigeration device of the first or second aspects of the present invention is preferably configured such that the liquid level detection circuit includes a bypass circuit and a temperature detection mechanism. The bypass circuit includes an open/close mechanism, a pressure reduction mechanism, and a heating mechanism, and connects the receiver with an intake side of the compressor. The temperature detection mechanism detects the temperature of the refrigerant after being heated by means of the heating mechanism.

In accordance with a fourth aspect of the invention, the refrigeration device of the third aspect of the present invention is preferably configured such that the heating mechanism is a heat exchanger that uses refrigerant which flows inside the main refrigerant circuit as a heating source.

With this refrigeration device, another external heating source such as for example an electric heater or the like will be unnecessary, because a heating mechanism is used that uses refrigerant which flows in the main refrigerant circuit as a heating source.

In accordance with a fifth aspect of the invention, the refrigeration device of the fourth aspect of the present invention is preferably configured such that the heating source of the heating mechanism is liquid refrigerant which flows in the main refrigerant circuit between a heat source side heat exchanger and user side heat exchangers. The heating mechanism is arranged in the bypass circuit more downstream of the flow of refrigerant than the pressure reduction mechanism.

With this refrigerant device, changes in refrigerant temperature will be small, and the refrigerant temperature will be comparatively stable, even if heat exchange is used, because the heating mechanism uses liquid refrigerant that flows in the main refrigerant circuit as a heating source. Because of this, refrigerant that flows in the liquid level detection circuit can be stably heated.

In accordance with a sixth aspect of the invention, the refrigeration device of the any one of the first through fifth aspects of the present invention preferably further includes an auxiliary liquid level detection circuit that has the same structure as that of the liquid level detection circuit, and is arranged so as to draw out a portion of refrigerant in the receiver from a reference position of the receiver that is continuously filled with liquid refrigerant even when the amount of refrigerant stored in the receiver has changed.

With this refrigeration device, by providing the auxiliary liquid level detection circuit having the same configuration as the liquid level detection circuit at the reference position at which liquid refrigerant is continuously stored in the receiver, the temperature of the refrigerant can be detected by means of each temperature detection mechanism of the two liquid level detection circuits, and the liquid level can be detected by comparing the temperature of the refrigerant detected by the temperature detection mechanism on the auxiliary liquid level detection circuit side as a reference, with the temperature of the refrigerant detected by the temperature detection mechanism on the liquid level detection circuit side. Thus, the presence or absence of a liquid level can be easily determined, and measurement accuracy can be further improved.

In accordance with a seventh aspect of the invention, the refrigeration device of the any one of the first through sixth aspects of the present invention is preferably configured such that the refrigerant that flows in the main refrigerant circuit and the liquid level detection circuit includes R32 at 50 wt % or greater.

When the refrigerant to be used includes R32 at 50 wt % or greater as the operating refrigerant, there will be times in which the presence or absence of a liquid level cannot be determined with good accuracy by a conventional liquid level detection circuit, because there will be a leftward inclination of the vapor line in the pressure-enthalpy chart at the condensation temperature (near 50° C.) of the refrigerant in the heat source side heat exchanger during cooling operations and refrigerant charging operations. However, with this refrigeration device, even when the above type of operating refrigerant is to be used, the liquid level detection circuit can determine the presence or absence of a liquid level at the predetermined position of the receiver with good accuracy because the heating mechanism is provided therein.

In accordance with a eighth aspect of the invention, a method of detecting the amount of refrigerant in a refrigeration device is conducted in a refrigeration device having a refrigerant circuit which includes a compressor that compresses gas refrigerant, a heat source side heat exchanger, and a receiver that stores liquid refrigerant. The includes a compressor operation step and a liquid level detection step. The compressor operation step increases pressure up to the point at which the refrigerant that flows in the refrigerant circuit can be condensed in the heat source side heat exchanger by operating the compressor. During the compressor operation step, the liquid level detection step will draw out a portion of the refrigerant in the receiver from a predetermined position of the receiver, will reduce the pressure of the refrigerant and heat it, will measure the refrigerant temperature, and will determined whether or not the liquid level in the receiver is at the predetermined position based upon the refrigerant temperature measured.

With this liquid level detection method of the refrigeration device, when the compressor operates to increase pressure up to the point at which the pressure of the refrigerant that flows in the refrigerant circuit will cause condensation in the heat source side heat exchanger, refrigerant in the receiver will be drawn out from the predetermined position of the receiver, the pressure of the refrigerant will be reduced and the refrigerant will be heated, and then the temperature of the refrigerant will be measured. With this arrangement, because there will be a large increase in the temperature of the refrigerant due to heating when the refrigerant drawn out from the receiver is in the gas state, and when in the liquid state, the heat energy due to heating will be consumed as latent heat of vaporization and thus there will be a small increase in the temperature of the refrigerant due to heating, the liquid level detection circuit can determine that the liquid refrigerant is not stored up to the predetermined position of the receiver when there is a large increase in refrigerant temperature, and can determine that the liquid refrigerant is stored up to the predetermined position of the receiver when there is a small increase in refrigerant temperature. Thus, even under conditions in which the refrigerant drawn out from the receiver is in the saturated gas state, and a two-phase state is produced during pressure reduction, because the liquid level detection circuit can determine whether or not liquid refrigerant is stored up to the predetermined position of the receiver, the determination accuracy thereof can be improved compared to when a conventional liquid level detection circuit is used to determine whether or not refrigerant is stored up to the predetermined position of the receiver by means of the size of the temperature reduction during pressure reduction.

DETAILED DESCRIPTION OF THE EMBODIMENTS OF THE INVENTION

Embodiments of the refrigeration device of the present invention will be described below with reference to the figures.

First Embodiment (1) Overall Configuration of an Air Conditioner

Figure 1:
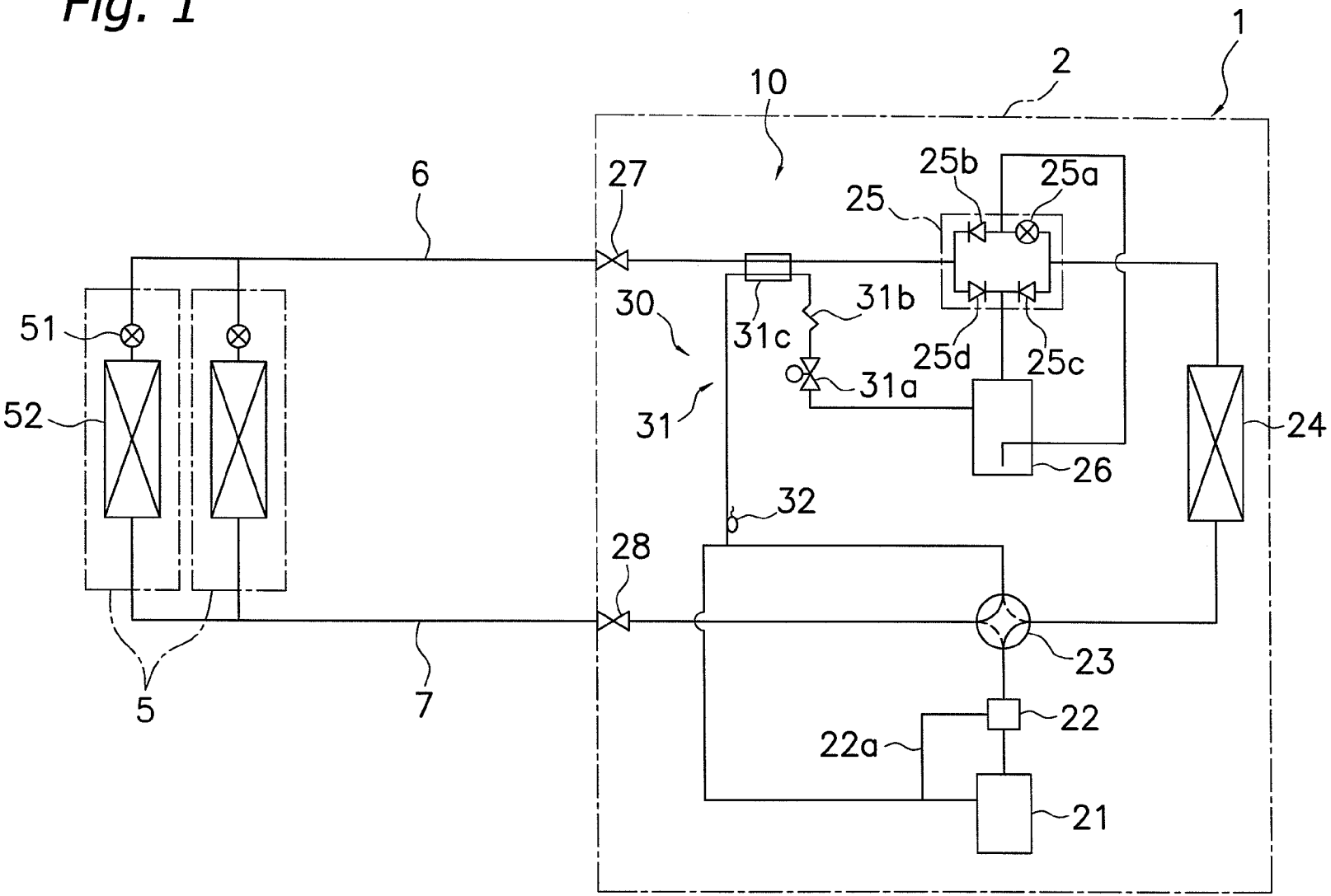
FIG. 1 is a schematic diagram of a refrigerant circuit of an air conditioner of a first embodiment of the present invention.

FIG. 1 is a schematic diagram of a refrigerant circuit of an air conditioner 1 of a first embodiment, and used as an example of the refrigeration device of the present invention. The air conditioner 1 includes, like the conventional air conditioner 901, a heat source unit 2, a plurality of (here, two) user units 5 that are connected in parallel to the heat source unit 2, and a liquid refrigerant connection line 6 and a gas refrigerant connection line 7 that serve to connect the heat source unit 2 and the user units 5. Here, a description of the structures of the user units 5 and the heat source unit 2, i.e., the structure of the main refrigerant circuit 10, will be omitted because they are the same as that of the conventional air conditioner 901 except for the liquid level detection circuit 30, and thus only the structure of the liquid level detection circuit 30 will be described.

The liquid level detection circuit 30 of the air conditioner 1 is connected, like the conventional liquid level detection circuit 930, between the first predetermined position $L_1$ of the receiver 26 and the intake side of the compressor 21, can draw out refrigerant from a predetermined position of the receiver 26, reduce the pressure of and heat the refrigerant, and then return the refrigerant to the intake side of the compressor 21.

The liquid level detection circuit 30 has a bypass circuit 31 which includes an open/close mechanism 31*a* composed of a solenoid valve, a pressure reduction mechanism 31*b* composed of a capillary tube provided on the downstream side of the open/close mechanism 31*a* and which serves to reduce the pressure of refrigerant, and a heating mechanism 31*c* composed of a heat exchanger that heats the refrigerant that was reduced in pressure. The liquid level detection circuit 30 further includes a temperature detection mechanism 32 composed of a thermistor that is arranged at a position on the downstream side of the heating mechanism 31*c*. The heating mechanism 31*c* is a heat exchanger that exchanges heat with liquid refrigerant (a heat source) that flows between the heat source side heat exchanger 24 and the user side heat exchangers 52 (more specifically, between a bridge circuit 25 and liquid side gate valves 27). For example, a double tube type heat exchanger may be used.

(2) Operation of the Air Conditioner

Figure 2:
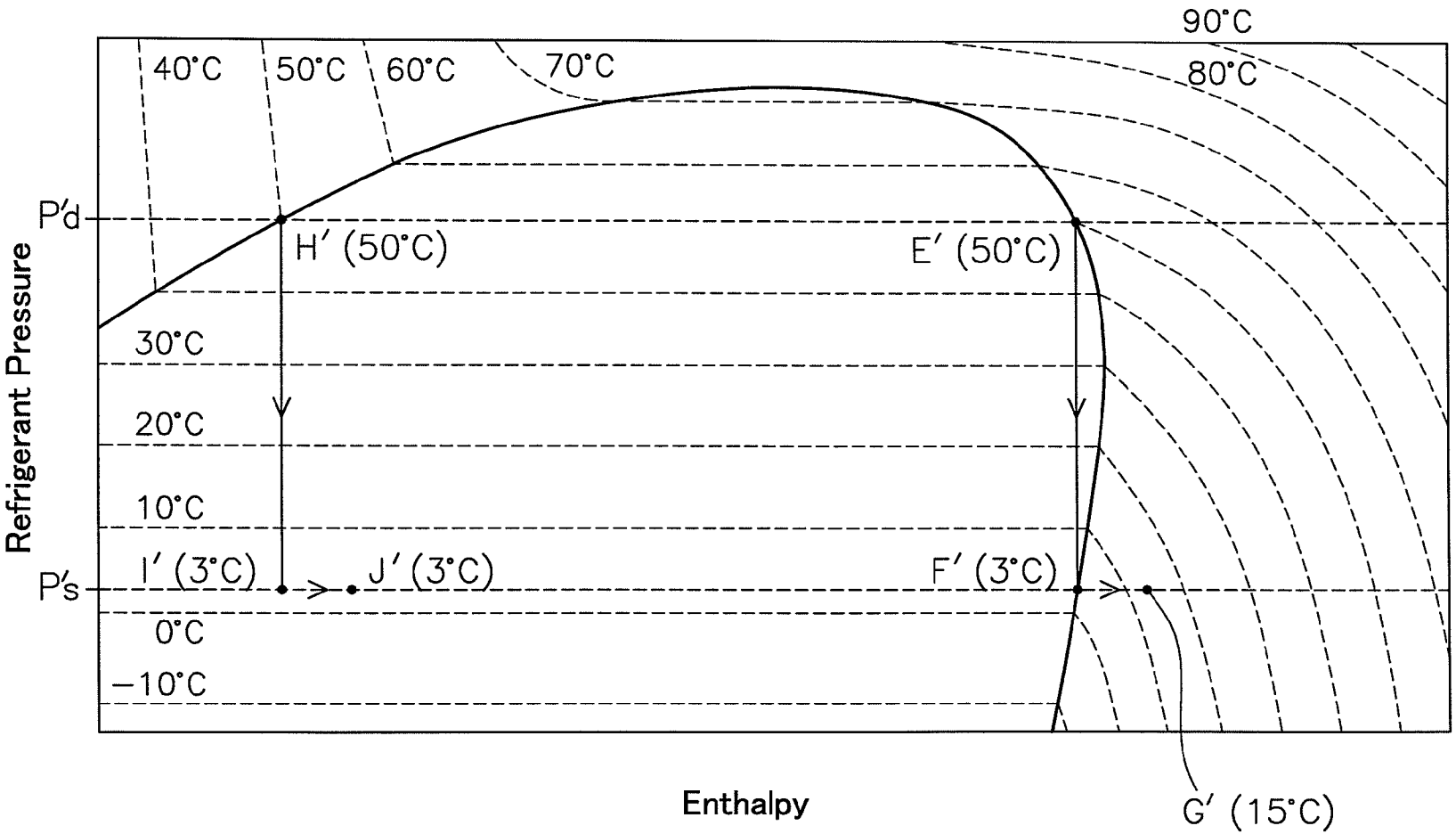
FIG. 2 is an enlarged view of FIG. 14, and shows the operation of a liquid level detection circuit of the first embodiment and a second embodiment.
Figure 14:
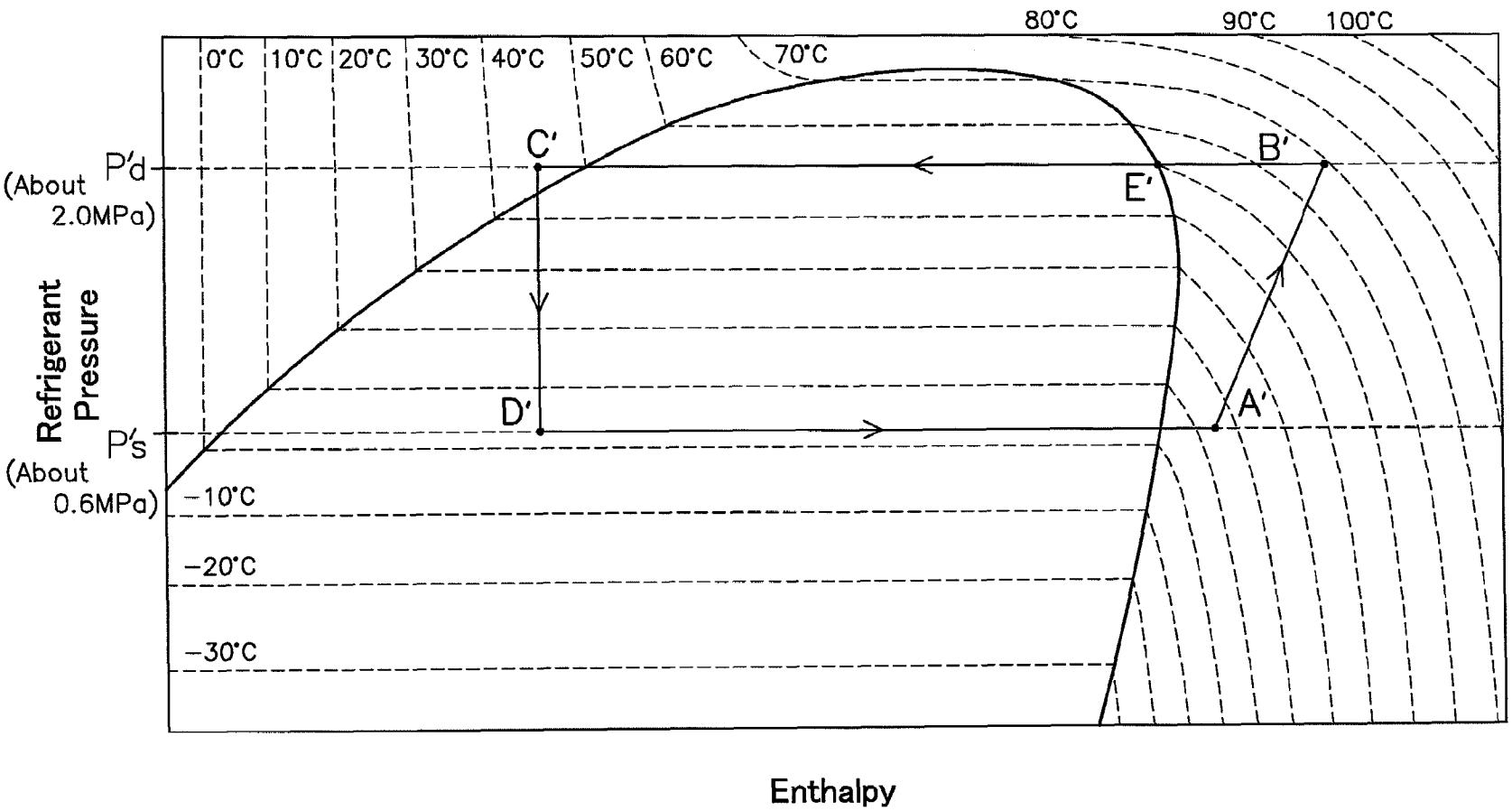
FIG. 14 is a R410A pressure-enthalpy graph, and shows the refrigerant cycle of a conventional air conditioner during cooling operations or refrigerant charging operations.
Figure 15:
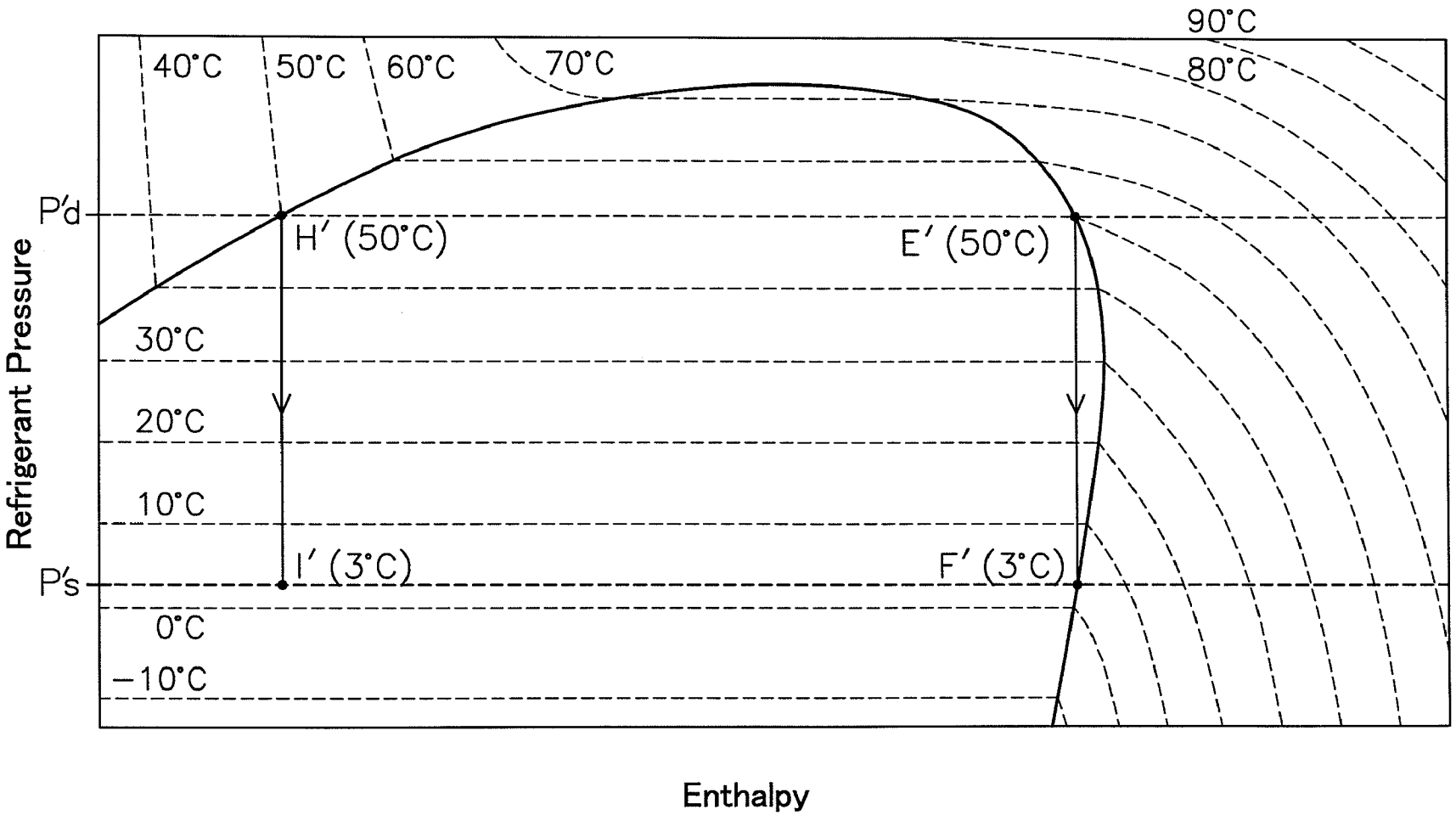
FIG. 15 is an enlarged view of FIG. 14, and shows the operation of a conventional liquid level detection circuit.

Next, FIGS. 1, 2 and 14 (when R410A is used as the operating refrigerant) will be employed to describe the operation of the air conditioner 1. Here, FIG. 2 is an enlarged view of FIG. 14, and shows the operation of the liquid level detection circuit 30.

A. Cooling Operations

First, cooling operations will be described. During cooling operations, the four way switching valve 23 is in the state shown by the solid lines in FIG. 1, i.e., the discharge side of the compressor 21 is connected to the gas side of the heat source side heat exchanger 24, and the intake side of the compressor 21 is connected to the gas side of the user side heat exchangers 52. In addition, the liquid side gate valve 27, the gas side gate valve 28, and the heat source side expansion valve 25*a* are opened, and the apertures of the user side expansion valves 51 are adjusted such that the refrigerant pressure is reduced.

When the heat source unit 2 fan, the user unit 5 fans, and the compressor 21 are actuated with the main refrigerant circuit 10 in this state, gas refrigerant at pressure $P'_s$ (about 0.9 MPa) (see point A' of FIG. 14) will be taken into the compressor 21 and compressed to pressure $P'_d$ (about 3.0 MPa). After this, the refrigerant will be sent to the oil separator 22 to separate the gas refrigerant and the oil (see point B' of FIG. 14). Then, the compressed refrigerant gas is sent to the heat source side heat exchanger 24 via the four way switching valve 23, exchanges heat with outdoor air, and is condensed (see point C' of FIG. 14). The condensed liquid refrigerant will be sent to the user units 5 side via the bridge circuit 25 and the liquid refrigerant connection line 6. Then, the liquid refrigerant that is sent to the user units 5 is reduced in pressure by the user side expansion valves 51 (refer to point D' of FIG. 14), and then exchanges heat with indoor air in the user side heat exchangers 52 and evaporated (refer to point A' of FIG. 14). The evaporated gas refrigerant is again taken into the compressor 21 via the gas refrigerant connection line 7 and the four way switching valve 23. In this way cooling operations will be performed.

B. Heating Operations

Next, heating operations will be described. During heating operations, the four way switching valve 23 is in the state shown by the broken lines in FIG. 1, i.e., the discharge side of the compressor 21 is connected to the gas side of the user side heat exchangers 52, and the intake side of the compressor 21 is connected to the gas side of the heat source side heat exchanger 24. In addition, the liquid side gate valve 27, the gas side gate valve 28 and the user side expansion valves 51 are opened, and the apertures of the heat source side expansion valve 25*a* is adjusted so as to reduce the pressure of the refrigerant.

With the main refrigerant circuit 10 in this state, when the heat source unit 2 fan, the user unit 5 fans, and the compressor 21 are actuated, the gas refrigerant will be taken into the compressor 21 and compressed, and then sent to the oil separator 22 in order for the oil and gas refrigerant to be separated. After that, the compressed gas refrigerant will be sent to the user units 5 via the four way switching valve 23 and the gas refrigerant connection line 7. Then, the gas refrigerant sent to the user units 5 exchanges heat with the user side heat exchangers 52 and is condensed. The condensed liquid refrigerant is sent to the heat source unit 2 via the user side expansion valve 51 and the liquid refrigerant connection line 6. Then, the liquid refrigerant sent to the heat source unit 2 is reduced in pressure at the heat source side expansion valve 25*a* of the bridge circuit 25, and then exchanges heat with outdoor air at the heat source side heat exchanger 24 and evaporated. The evaporated gas refrigerant is again taken into the compressor 21 via the four way switching valve 23. In other words, during heating operations, the refrigerant state will change in the order shown in FIG. 14, i.e., point A', point D', point C', point B', and point A'. This is reversed during cooling operations. In this way heating operations will be performed.

C. Refrigerant Charging Operation

Next, FIGS. 2 and 14 will be employed to describe the operation when refrigerant is charged into the main refrigerant circuit 10.

First, the configuration of the main refrigerant circuit 10 will be placed into the same configuration as that during cooling operations. Then, with the main refrigerant circuit 10 in this state and in the same way as the conventional air conditioner 901, refrigerant is charged into the main refrigerant circuit 10 from the exterior thereof while performing the same operation as the aforementioned cooling operation.

Then, while the aforementioned refrigerant charging operation is performed, an operation will be performed in which the open/close mechanism 31*a* of the liquid level detection circuit 30 is opened, a portion of the refrigerant is drawn out from the predetermined position of the receiver 26, the pressure of the refrigerant is reduced in the pressure reduction mechanism 31*b*, the refrigerant is heated in the heating mechanism 31*c*, the temperature of the refrigerant is measured after heating, and then the refrigerant is returned to the intake side of the compressor 21.

In the event that the amount of the liquid refrigerant stored in the receiver 26 is low and the liquid level of the liquid refrigerant does not reach the first predetermined position $L_1$, gas refrigerant in the saturated state (see point E' of FIG. 2) will flow into the liquid level detection circuit 30. This gas refrigerant will be reduced in pressure to pressure $P_s'$ by the pressure reduction mechanism 31*b*, placed into the two-phase state, and reduced in temperature from about 50° C. to about 3° C. (a temperature reduction of about 47° C.)(see point F' of FIG. 2). The refrigerant in the two-phase state will exchange heat with the refrigerant that flows in the main refrigerant circuit 10 (more specifically, between the bridge circuit 25 and the liquid side gate valve 27) and heated by the heating mechanism 31*c* (see point G' of FIG. 2). Thus, the refrigerant in the two-phase state will be heated from about 3° C. to about 15° C. (a temperature increase of about 12° C.) and placed into the superheated gas state.

After this, when the liquid level of the liquid refrigerant reaches the first predetermined position $L_1$ of the receiver 26 and liquid refrigerant in the saturated state in the receiver 26 flows into the liquid level detection circuit 30 (see point H' of FIG. 2), the temperature of the gas refrigerant will be rapidly reduced from about 50° C. to about 3° C. (a temperature reduction of about 47° C.)(see point I' of FIG. 2) by reducing the pressure thereof to pressure $P_s'$ by means of the pressure reduction mechanism 31*b* and the occurrence of flash evaporation. The refrigerant in the two-phase state will be heated by means of the heating mechanism 31*c* (see point J' of FIG. 2). Thus, the refrigerant in the two-phase state will capture the latent heat of vaporization and further evaporate, but will not reach the point at which it entirely evaporates, and the temperature thereof will remain at about 3° C.

Then, the liquid level detection circuit 30 will use a large temperature increase during heating in the liquid level detection circuit 30 when the refrigerant stored in the receiver 26 is in the gas state, and use a small temperature increase during heating when the refrigerant is in the liquid state, to detect that the required amount of refrigerant has been charged by determining that the liquid refrigerant in the receiver 26 has not been stored up to the first predetermined position $L_1$ when the temperature increase is large, and determining that the liquid refrigerant in the receiver 26 has been stored up to the first predetermined position $L_1$ when the temperature increase is small, and then ending the refrigerant charging operation.

(3) Special Characteristics of the Air Conditioner

The air conditioner 1 of the present embodiment, and particularly the liquid level detection circuit 30, have the following special characteristics.

The liquid level detection circuit 30 capable of measuring the temperature of the refrigerant drawn out from the first predetermined position $L_1$ of the receiver 26 after pressure reduction and heating is provided in the air conditioner 1. With this arrangement, because there will be a large increase in the temperature of the refrigerant due to heating when the refrigerant drawn out from the receiver 26 is in the gas state, and when in the liquid state, the heat energy due to heating will be consumed as latent heat of vaporization and thus there will be a small increase in the temperature of the refrigerant due to heating, the liquid level detection circuit 30 can determine that the liquid refrigerant is not stored up to the first predetermined position $L_1$ of the receiver 26 when there is a large increase in refrigerant temperature, and can determine that the liquid refrigerant is stored up to the first predetermined position $L_1$ of the receiver 26 when there is a small increase in refrigerant temperature. Thus, even under conditions in which the refrigerant drawn out from the receiver 26 is in the saturated gas state, and a two-phase state is produced during pressure reduction (point E' to point F' of FIG. 2), because the liquid level detection circuit 30 can determine whether or not liquid refrigerant is stored up to the first predetermined position $L_1$ of the receiver 26, the determination accuracy thereof can be improved compared to when the conventional liquid level detection circuit 930 is used which determines whether or not refrigerant is stored up to the first predetermined position $L_1$ of the receiver 26 by means of the size of the temperature reduction during pressure reduction.

In particular, when the refrigerant to be used includes 50 wt % or more of R32 (which is similar to the R410A described above) as the operating refrigerant, there will be times in which the presence or absence of a liquid level cannot be determined with good accuracy by the conventional liquid level detection circuit 930, because there will be a leftward inclination of the vapor line in the pressure-enthalpy chart at the condensation temperature (near 50° C.) of the refrigerant in the heat source side heat exchanger 24 during cooling operations and refrigerant charging operations. However, even when the above type of operating refrigerant is to be used, the liquid level detection circuit 30 can determine the presence or absence of a liquid level at the first predetermined position $L_1$ of the receiver 26 with good accuracy because the heating mechanism 31*c* is provided therein.

Figure 3:
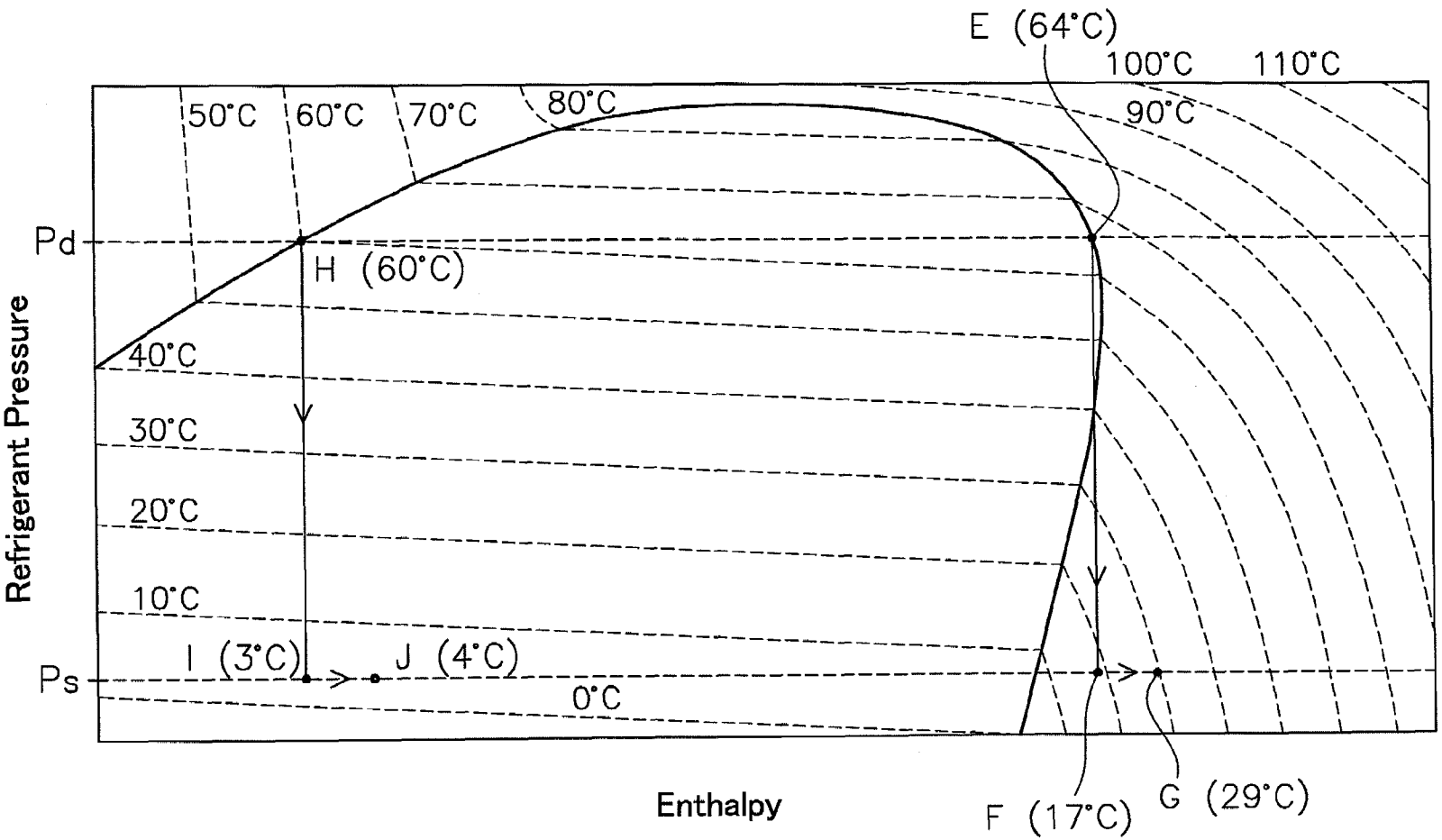
FIG. 3 is an enlarged view of FIG. 12, and shows the operation of the liquid level detection circuit of the first embodiment.
Figure 13:
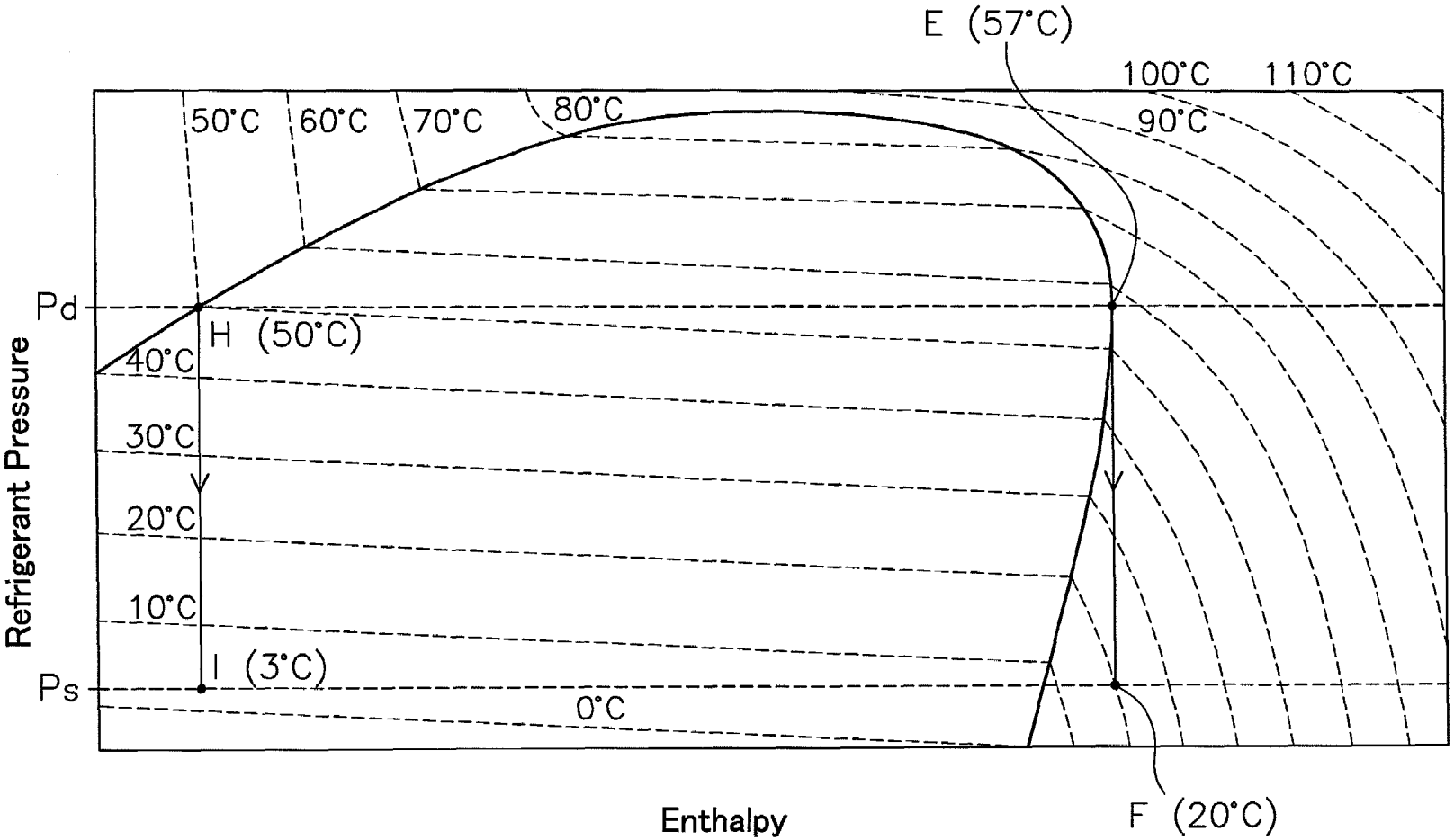
FIG. 13 is an enlarged view of FIG. 12, and shows the operation of a conventional liquid level detection circuit.

In addition, even if R407C or R22 are used, under conditions in which operations are performed when the outdoor air temperature is high and the condensation temperature of the refrigerant in the heat source side heat exchanger 24 is high (e.g., 60° C.), the same phenomenon as when R410A is used will occur, and there will be a slight tendency for the determination accuracy to worsen with the conventional liquid level detection circuit 930, because, as shown in point E of FIG. 3, the position of point E in FIGS. 13 and 14 will move upward and the inclination of the vapor line near point E will be leftward. However, even in this situation, as shown in FIG. 3, because the temperature increase after heating of the saturated gas refrigerant (from point F to point G of FIG. 3) by means of the heating mechanism 31*c* of the liquid level detection circuit 30 will be about 12° C. (an increase from about 17° C. to about 29° C.), and the temperature increase after heating of the saturated liquid refrigerant (from point I to point J of FIG. 3) by means of the heating mechanism 31*c* of the liquid level detection circuit 30 will be about 1° C. (an increase from 3° C. to 4° C.), the liquid level detection circuit 30 can, like when R410A is used, detect the presence or absence of a liquid level at the first predetermined position $L_1$ of the receiver 26 with good accuracy.

Furthermore, the heating mechanism 31*c* can stably heat the refrigerant, because the heating mechanism 31*c* is a heat exchanger that uses the liquid refrigerant in the main refrigerant circuit 10 having a relatively stable temperature as a heating source.

(4) Modification 1

Figure 4:
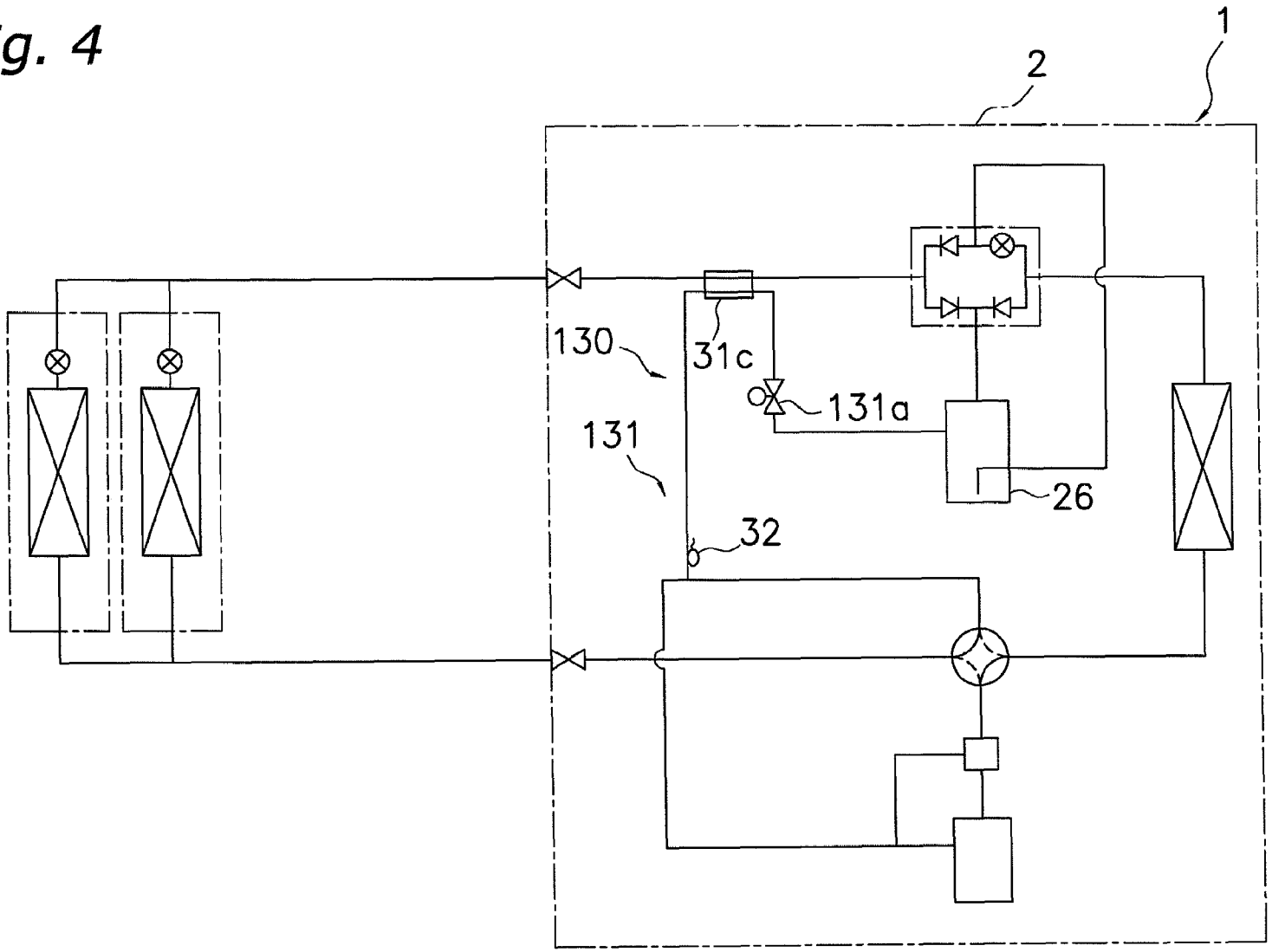
FIG. 4 is a schematic diagram of a refrigerant circuit of an air conditioner having a first modification of the liquid level detection circuit of the first embodiment.

The pressure reduction mechanism 31*b* is provided in the liquid level detection circuit 30 on the downstream side of the open/close mechanism 31*a*, but as shown in FIG. 4, a liquid level detection circuit 130 may be used which has a bypass circuit 131 that includes an open/close mechanism 131*a* that also functions as a pressure reduction mechanism in addition to the open/close mechanism 31*a*. The same effects as those when the liquid level detection circuit 30 is provided can be obtained in this configuration as well.

(5) Modification 2

Figure 5:
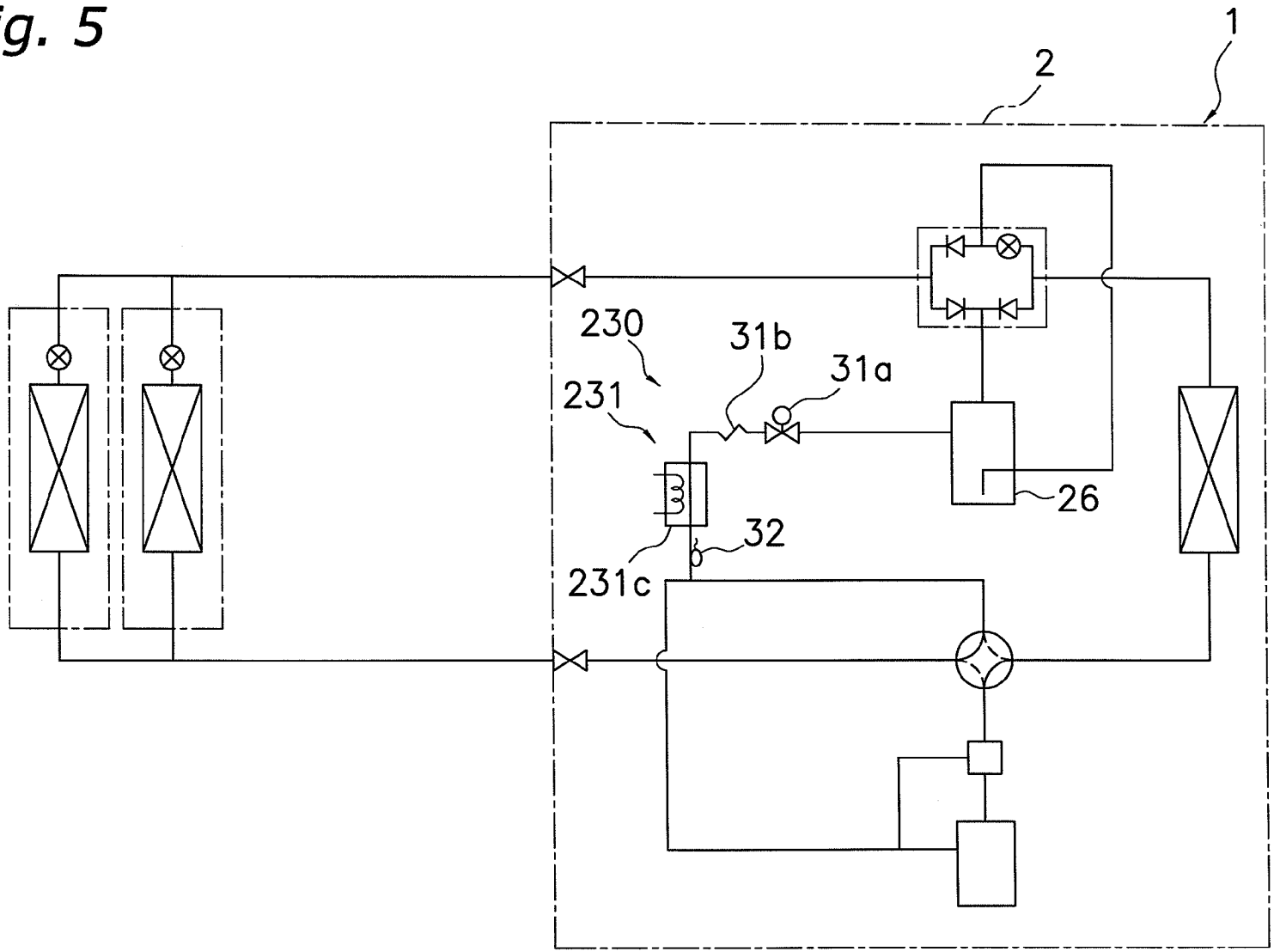
FIG. 5 is a schematic diagram of a refrigerant circuit of an air conditioner having a second modification of the liquid level detection circuit of the first embodiment.

The heating mechanism 31*c* is arranged in the liquid level detection circuit 30 and is composed of a heat exchanger that uses liquid refrigerant as a heat source, however, as shown in FIG. 5, a liquid level detection circuit 230 may be used which has a bypass circuit 231 including a heating mechanism 231*c* of a type that heats refrigerant by means of an external heat source such as an electric heater or the like. The same effects as those when the liquid level detection circuit 30 is provided can be obtained in this configuration as well.

(6) Modification 3

Figure 6:
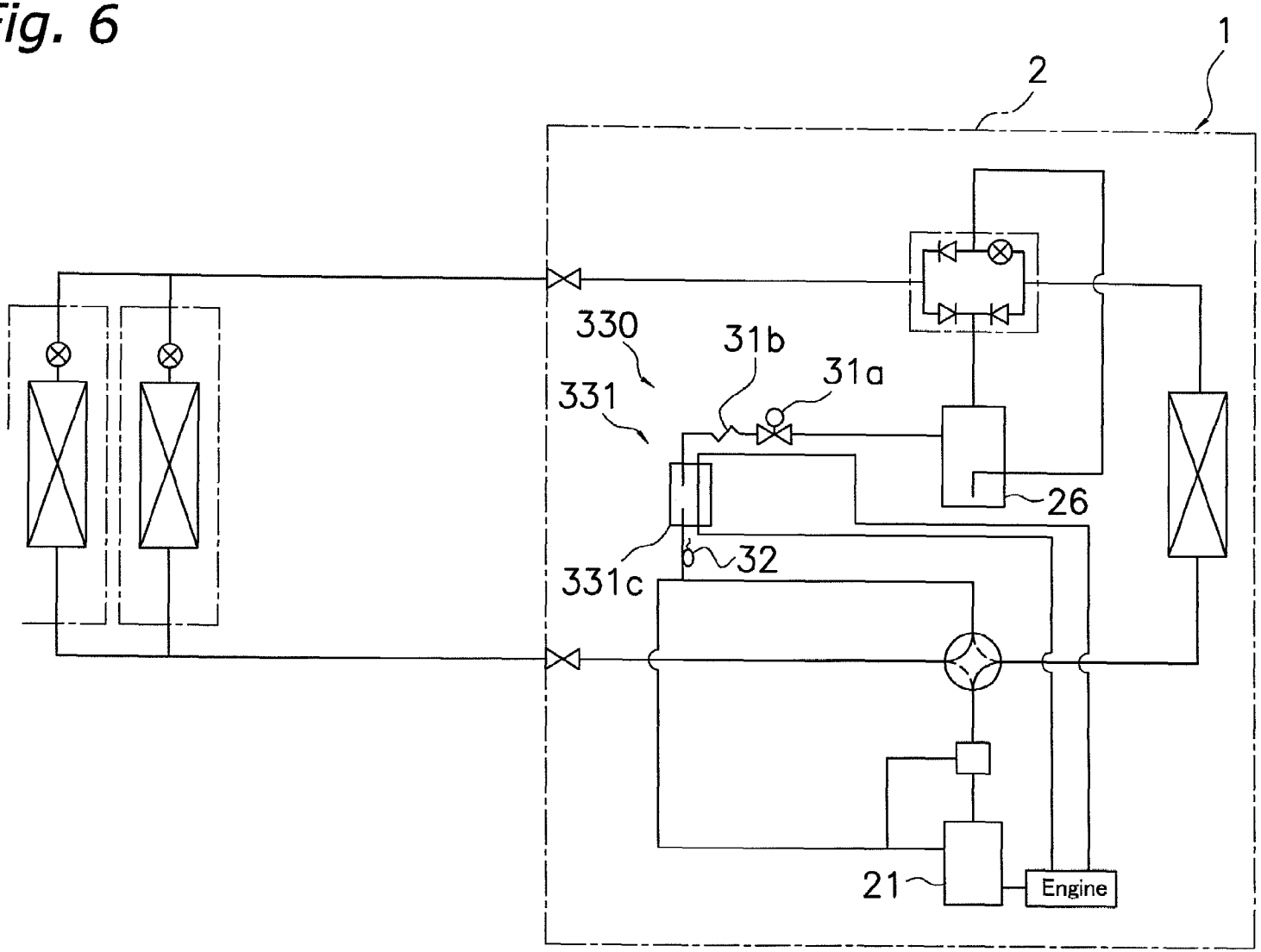
FIG. 6 is a schematic diagram of a refrigerant circuit of an air conditioner having a third modification of the liquid level detection circuit of the first embodiment.

The heating mechanism 31*c* is arranged in the liquid level detection circuit 30 and is composed of a heat exchanger that uses liquid refrigerant as a heat source, however, as shown in FIG. 6, when the compressor 21 is an engine drive compressor, a liquid level detection circuit 330 may be used which has a bypass circuit 331 including a heating mechanism 331*c* that uses the exhaust heat of the engine. The same effects as those when the liquid level detection circuit 30 is provided can be obtained in this configuration as well.

(7) Modification 4

Figure 7:
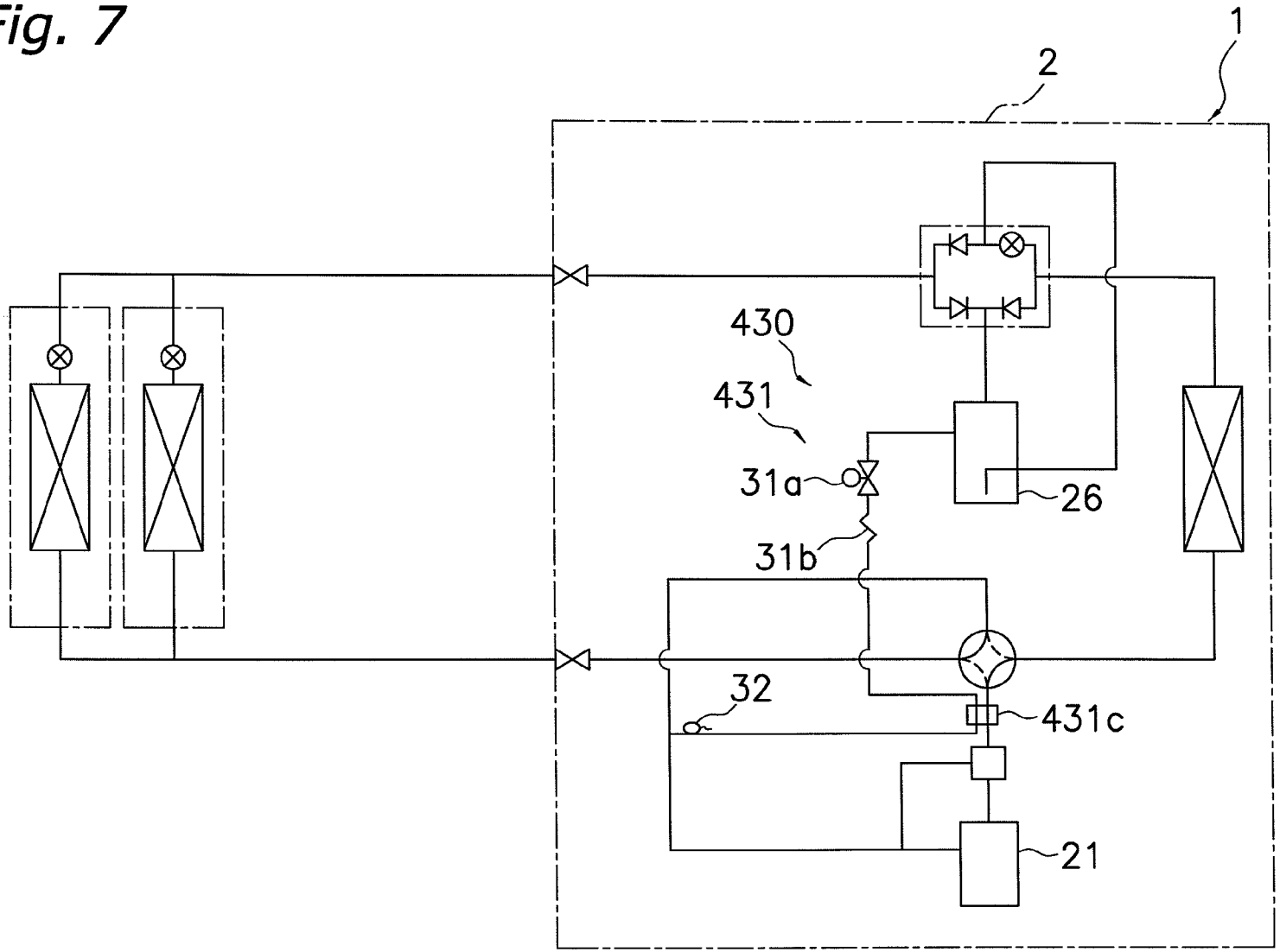
FIG. 7 is a schematic diagram of a refrigerant circuit of an air conditioner having a fourth modification of the liquid level detection circuit of the first embodiment.

The heating mechanism 31*c* is arranged in the liquid level detection circuit 30 and is composed of a heat exchanger that uses liquid refrigerant as a heat source, however, as shown in FIG. 7, a liquid level detection circuit 430 may be used which has a bypass circuit 431 including a heating mechanism 431*c* composed of a heat exchanger that uses gas refrigerant discharged from the compressor 21 as a heat source. This configuration is slightly inferior to the heating mechanism 31*c* of the liquid level detection circuit 30 that uses liquid refrigerant as a heat source, from the point of view of increasing the temperature change of the gas refrigerant used as a heating source and discharged from the compressor 21, and from the point of view of stable heating. However, the connection sequence between the pressure reduction mechanism 31*b* and the heating mechanism 431*c* of this configuration is not limited, and can simplify the circuit configuration.

Second Embodiment

In the air conditioner 1 of the first embodiment, the liquid level detection circuit 30 only provides a first predetermined position $L_1$ of the receiver 26 that corresponds to the refrigerant amount required during refrigerant charging. However, in order to determine whether or not the receiver 26 is full of liquid, a liquid level detection circuit having the same configuration as that of the liquid level detection circuit 30 may be provided at a second predetermined position $L_2$ at the apex of the receiver 26.

Furthermore, an auxiliary liquid level detection circuit having the same configuration as that of the liquid level detection circuit 30 may be provided at a reference position $L_R$ in which liquid refrigerant is continuously filled on the bottom portion of the receiver 26.

Figure 8:
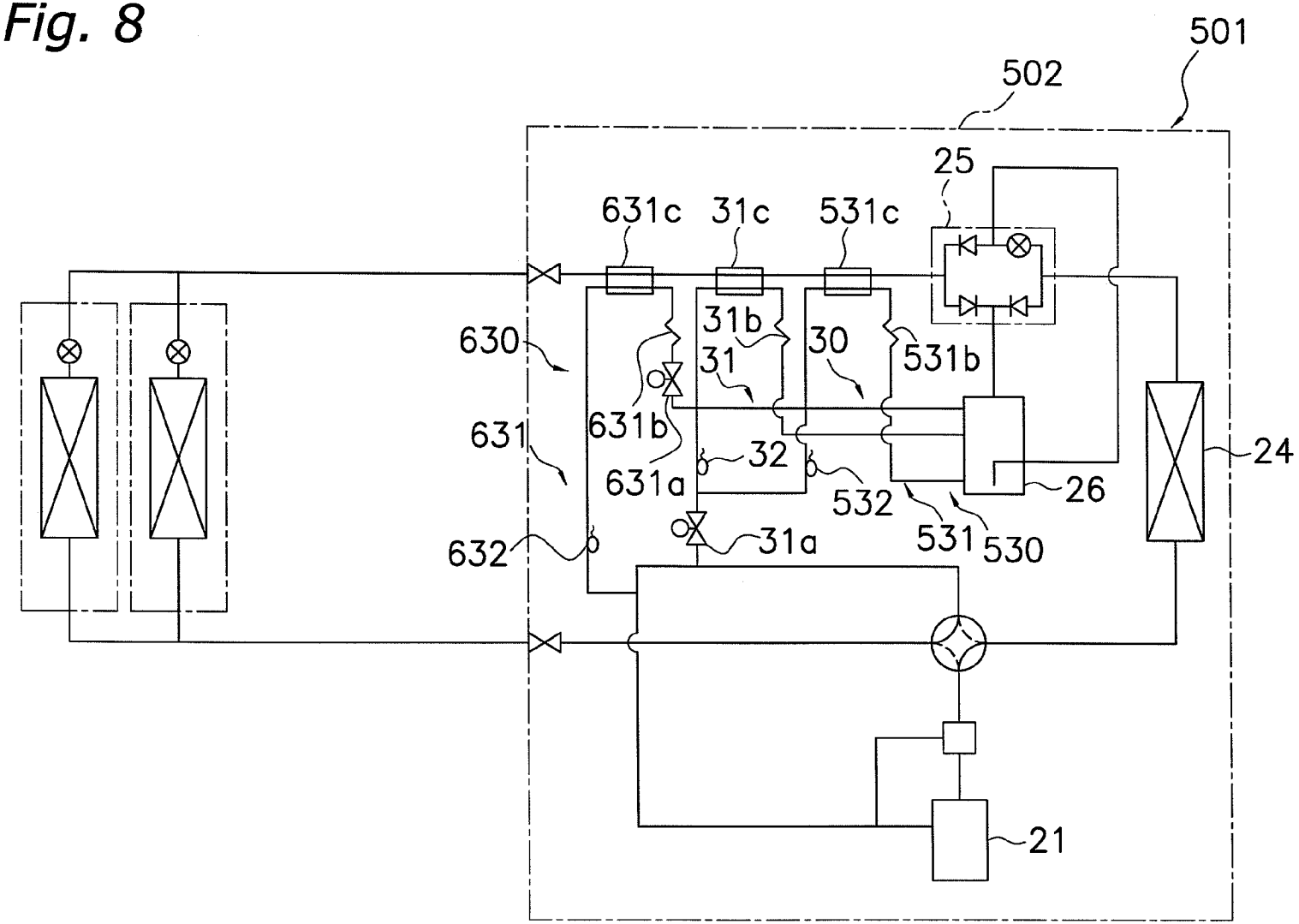
FIG. 8 is a schematic diagram of a refrigerant circuit of an air conditioner of a second embodiment of the present invention.

More specifically, as shown in FIG. 8, the configuration of the main refrigerant circuit 10 and the liquid level detection circuit 30 of an air conditioner 501 of the present embodiment is the same as that of the air conditioner 1 of the first embodiment, but differ in two respects. First, the air conditioner 501 includes a liquid level detection circuit 630 having a configuration that is the same as that of the liquid level detection circuit 30 and is at the apex of the receiver 26, and second, the auxiliary liquid level detection circuit 530 has a configuration that is the same as that of the liquid level detection circuit 30 and is at the bottom portion of the receiver 26.

Figure 9:
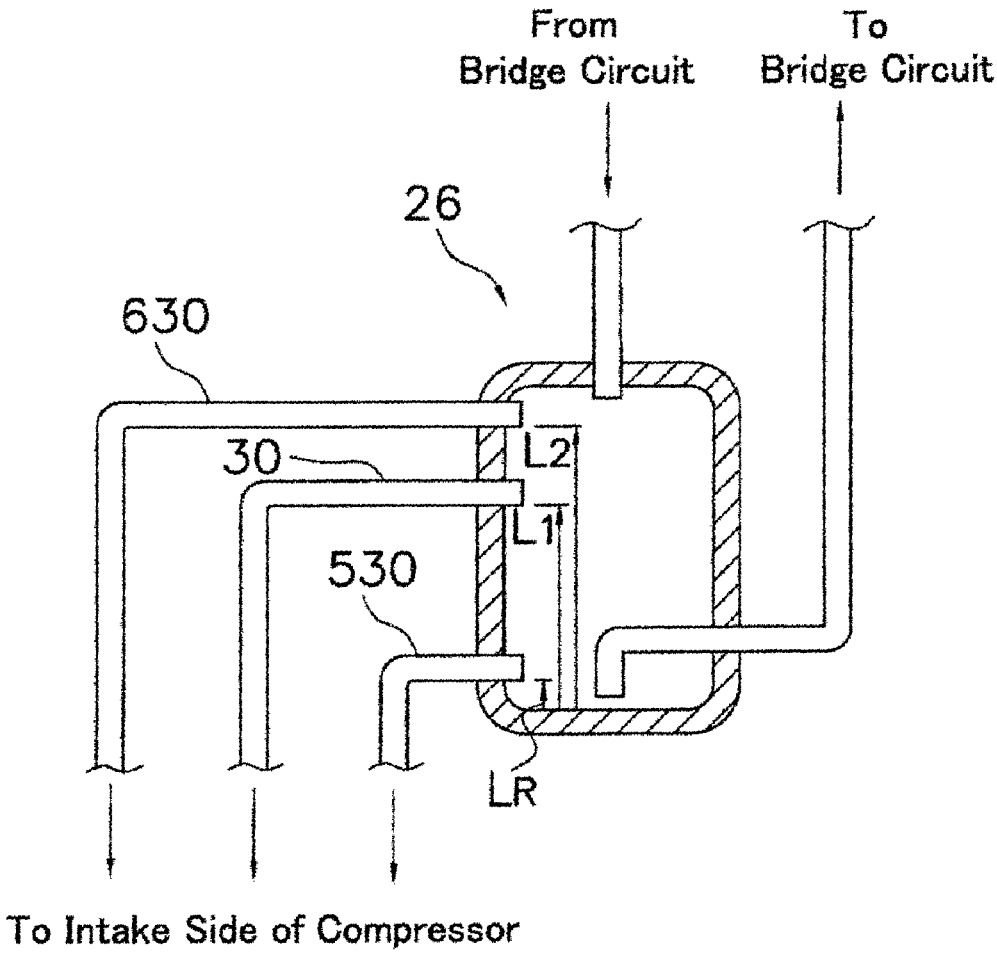
FIG. 9 shows a receiver of the air conditioner of the second embodiment.
Figure 10:
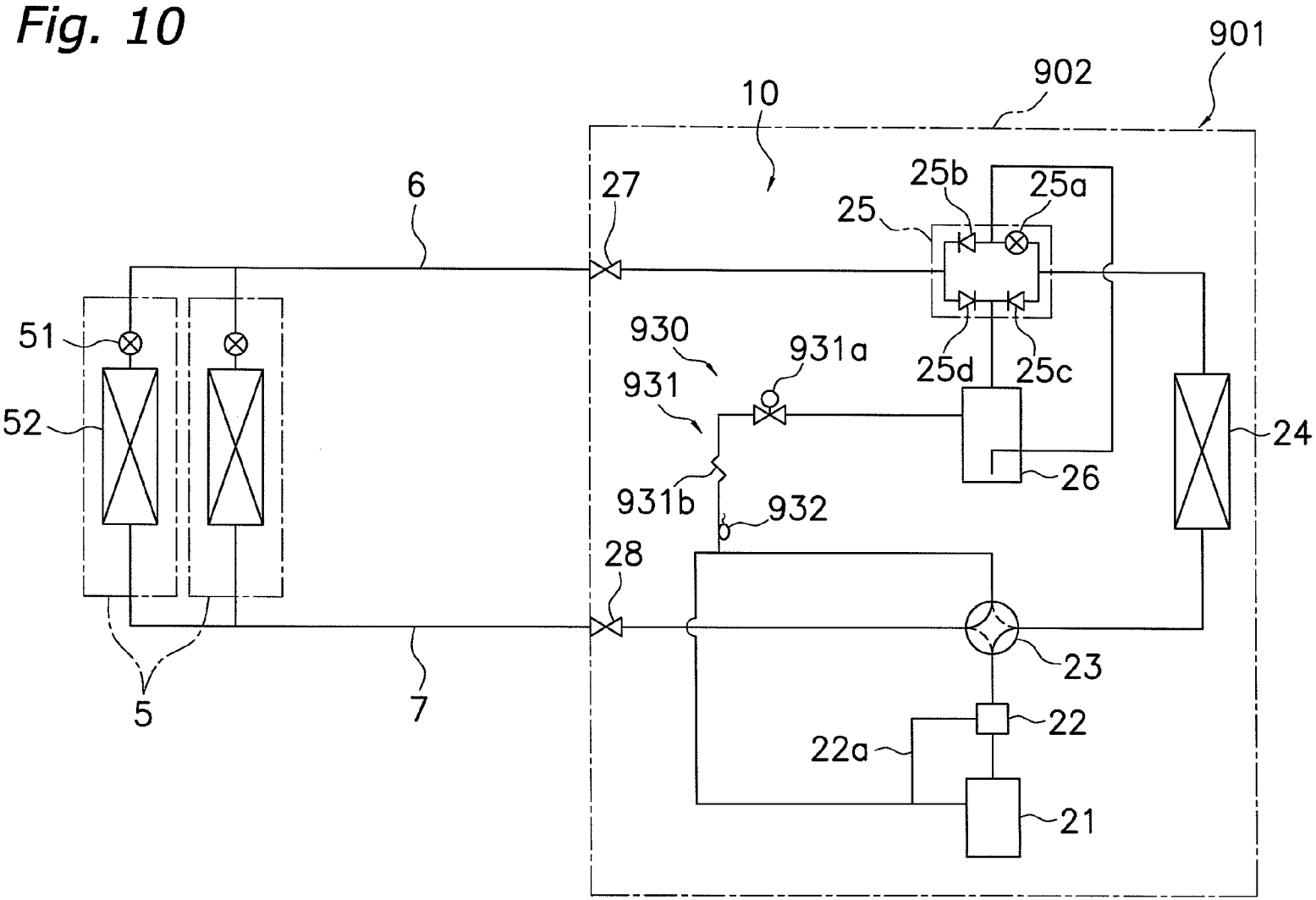
FIG. 10 is a schematic diagram of a refrigerant circuit of a conventional air conditioner.
Figure 11:
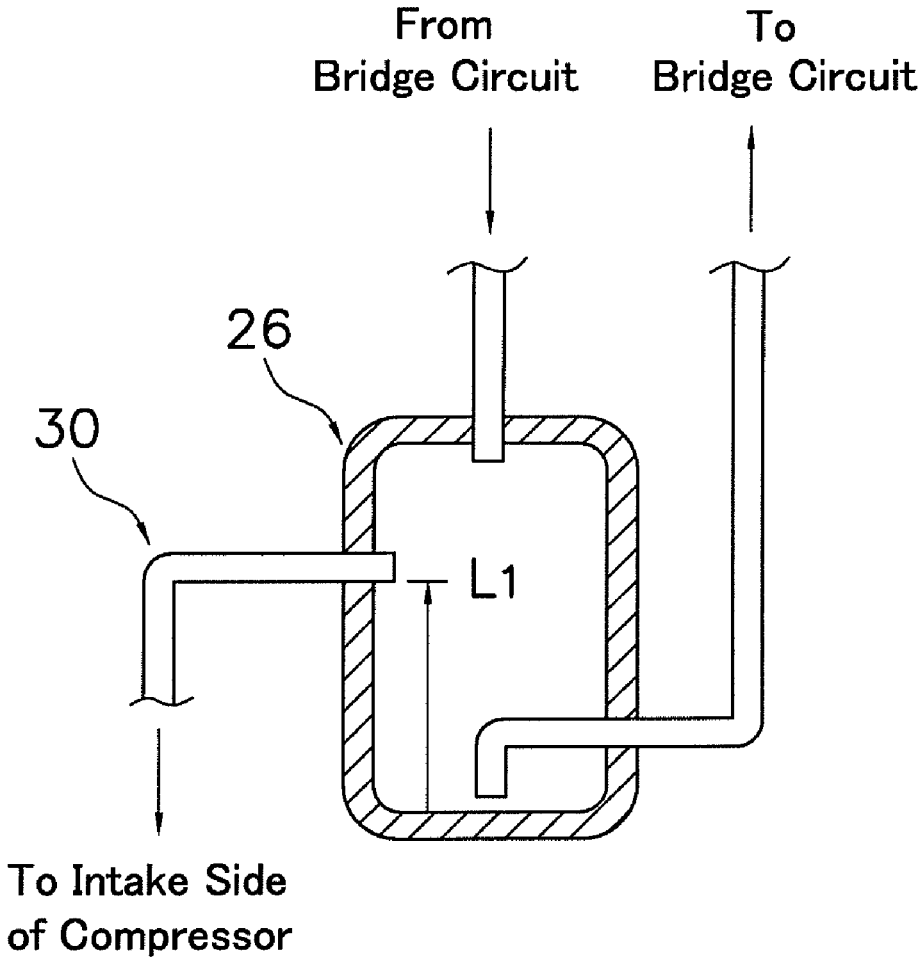
FIG. 11 shows a conventional receiver of an air conditioner and a receiver of the air conditioner of the first embodiment.
Figure 12:
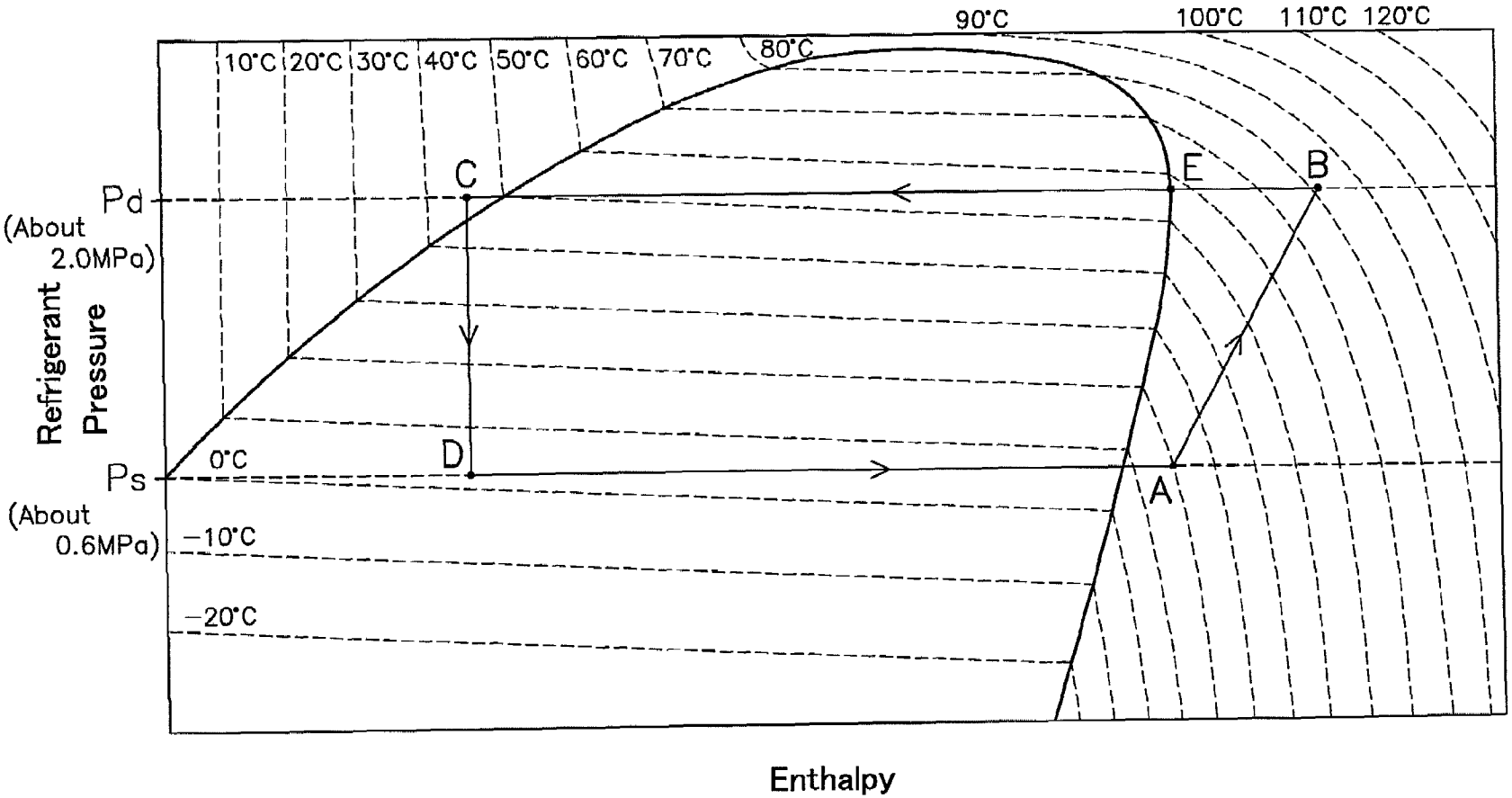
FIG. 12 is a R407C pressure-enthalpy graph, and shows the refrigerant cycle of a conventional air conditioner during cooling operations or refrigerant charging operations.

As shown in FIG. 9, the liquid level detection circuit 630 is connected between the second predetermined position $L_2$ at the apex of the receiver 26 and the intake side of the compressor 21, and like the liquid level detection circuit 30, can draw out refrigerant from the receiver 26, reduce the pressure of and heat the refrigerant, and then return the refrigerant to the intake side of the compressor 21. Here, as noted above, the second predetermined position $L_2$ of the receiver 26 to which the liquid level detection circuit 630 is connected is the position at which a liquid full state of the receiver 26 above the first predetermined position $L_1$ can be detected (see FIG. 9). Like the liquid level detection circuit 30, the liquid level detection circuit 630 includes a bypass circuit 631 including an open/close mechanism 631*a*, a pressure reduction mechanism 631*b*, and a heating mechanism 631*c*, and a temperature detection mechanism 632.

As shown in FIG. 9, the auxiliary liquid level detection circuit 530 is connected between the reference position $L_R$ on the bottom portion of the receiver 26 and the intake side of the compressor 21, and like the liquid level detection circuit 30, can draw out refrigerant from the receiver 26, reduce the pressure of and heat the refrigerant, and then return the refrigerant to the intake side of the compressor 21. Here, the reference position $L_R$ of the receiver 26 to which the liquid level detection circuit 530 is connected is the position at which liquid refrigerant is continuously stored on the bottom of the receiver 26 during operation (see FIG. 9). Note that, because the auxiliary liquid level detection circuit 530 is used at the same time as the liquid level detection circuit 30 (described below), as shown in FIG. 9, the line portion in which the bypass circuit 531 of the auxiliary liquid level detection circuit 530 returns to the intake side of the compressor 21 is shared, the open/close mechanism 31*a* is arranged on this shared line portion, and thus the open/close mechanism 31*a* of the liquid level detection circuit 30, a portion of the lines, and the like, will be used for more than one purpose. In other words, the auxiliary liquid level detection circuit 530 has the bypass circuit 531 including the pressure reduction mechanism 531*b* and the heating mechanism 531*c* (however, the open/close mechanism 31*a* and a portion of the lines will also be used with the bypass circuit 31), and a temperature detection mechanism 532.

Next, FIG. 2 will be employed to describe the operation of the liquid level detection circuits 30, 630 and the auxiliary liquid level detection circuit 530 of the air conditioner 501 (when R410A is used as the operating refrigerant) during refrigerant charging operation.

By opening the open/close mechanism 31*a* of the liquid level detection circuit 30, an operation will be performed which draws out portions of the refrigerant from the respective first predetermined position $L_1$ and the reference position $L_R$ of the receiver 26, reduces the pressure of the refrigerant in the pressure reduction mechanisms 31*b*, 531*b*, heats the refrigerant in the heating mechanisms 31*c*, 531*c*, measures the temperature of the refrigerant after heating by the temperature detection mechanisms 32, 532, and then returns the refrigerant to the intake side of the compressor 21.

In the event that the amount of the liquid refrigerant stored in the receiver 26 is low, and the liquid level of the liquid refrigerant does not reach the first predetermined level $L_1$, gas refrigerant in the saturated state (see point E' of FIG. 2) will flow therein. This gas refrigerant will be reduced in pressure to pressure $P_s'$ by the pressure reduction mechanism 31*b*, will be placed into the two-phase state, and reduced in temperature from about 50° C. to about 3° C. (a temperature reduction of about 47° C.)(see point F' of FIG. 2). The refrigerant in the two-phase state will be heated by means of the heating mechanism 31*c* (see point G' of FIG. 2). Thus, the refrigerant in the two-phase state will be heated from about 3° C. to about 15° C. (a temperature increase of about 12° C.) and placed into the superheated gas state. On the other hand, liquid refrigerant in the saturated state (point H' of FIG. 2) will flow into the liquid level detection circuit 530. By reducing the pressure of this liquid refrigerant to pressure $P_s'$ by the pressure reduction mechanism 531*b*, the temperature of the liquid refrigerant will rapidly reduce from about 50° C. to about 3° C. (a temperature reduction of about 47° C.)(see point I' of FIG. 2). The refrigerant in the two-phase state will exchange heat with the liquid refrigerant that flows in the main refrigerant circuit 10 and will be heated by the heating mechanism 531*c* (see point J' of FIG. 2). Thus, the refrigerant in the two-phase state will capture the latent heat of vaporization and further evaporate, but will not reach the point at which it entirely evaporates, and the temperature thereof will remain at about 3° C. In other words, the temperature of the refrigerant drawn out from the first predetermined position $L_1$ of the receiver 26 is higher than the temperature of the refrigerant drawn out from the reference position $L_R$ of the receiver 26, and in this way it can be determined that the liquid level in the receiver 26 has not reached the first predetermined position $L_1$.

After this, when the liquid level of the liquid refrigerant reaches the first predetermined position $L_1$ of the receiver 26 and liquid refrigerant in the saturated state in the liquid level detection circuit 30 (see point H' of FIG. 2) flows into the receiver 26, like with the auxiliary liquid level detection circuit 530, by reducing the pressure of this liquid refrigerant to pressure $P_s'$ by means of the pressure reduction mechanism 31*b*, the temperature of the refrigerant will rapidly reduce from about 50° C. to about 3° C. due to the occurrence of flash evaporation (a temperature reduction of about 47° C.)(see point I' of FIG. 2). The refrigerant in the two-phase state will be heated by means of the heating mechanism 31*c* (see point J' of FIG. 2). Thus, the refrigerant in the two-phase state will capture the latent heat of vaporization and further evaporate, but will not reach the point at which it entirely evaporates, and the temperature thereof will remain at about 3° C. In other words, the temperature of the refrigerant drawn out from the first predetermined position $L_1$ of the receiver 26 is the same temperature as the refrigerant drawn out from the reference position $L_R$ of the receiver 26, and in this way it can be determined that the liquid level in the receiver 26 has reached the first predetermined position $L_1$.

As described above, by providing the auxiliary liquid level detection circuit 530 having the same configuration as the liquid level detection circuit 30 in the air conditioner 501 and at the reference position $L_R$ at which liquid refrigerant is continuously stored in the receiver 26, the temperature of the refrigerant can be detected by means of each temperature detection mechanism 32, 532 of the two liquid level detection circuits 30, 530, and the liquid level can be detected by comparing the temperature of the refrigerant detected by the temperature detection mechanism 532 on the auxiliary liquid level detection circuit 530 side as a reference, with the temperature of the refrigerant detected by the temperature detection mechanism 32 on the liquid level detection circuit 30 side. Thus, the presence or absence of a liquid level can be easily determined, and measurement accuracy can be further improved.

In addition, the reliability of the refrigerant charging task, as well as the aforementioned operations, can be improved by suitably opening the open/close mechanism 631*a* of the liquid level detection circuit 630, determining the presence or absence of a liquid level at the second predetermined position $L_2$ of the receiver 26, and detecting whether or not the receiver 26 is overcharged.

Other Embodiments

Although embodiments of the present invention were described above based upon the figures, the specific configuration of the present invention is not limited to these embodiments, and can be modified within a range that does not depart from the essence of the invention.

(1) In the aforementioned embodiments, the present invention was applied to an air conditioner, but may also be applied to other refrigeration devices having a vapor compression type of refrigeration circuit.

(2) In the aforementioned embodiments, the present invention was applied to an air conditioner in which a so-called air cooled type of heat source unit is employed. However, the present invention may also be applied to an air conditioner in which a water cooled type or an ice storage type of heat source unit is employed.

(3) In the aforementioned embodiments, the liquid level detection circuit is configured so as to reduce the pressure of the refrigerant drawn out from the first predetermined position of the receiver with the pressure reduction mechanism, and then heat the refrigerant with the heating mechanism. However, a circuit configuration which heats the refrigerant with the heating mechanism, and then reduces the pressure thereof with the pressure reduction mechanism is also possible. Even with this configuration, like with the aforementioned embodiments, the liquid level determination can be performed because the temperature increase due to the heating mechanism will be large when the refrigerant drawn out from the first predetermined position of the receiver is gas refrigerant, and the temperature increase due to the heating mechanism will be small when the refrigerant is liquid refrigerant.

(4) In the aforementioned second embodiment, the liquid level detection circuit was newly arranged at the apex of the receiver, but a configuration is also possible in which a conventional gas venting circuit arranged on the apex of the receiver is used. In this configuration, a circuit that is identical to that of the second embodiment can be formed by simply arranging a heating mechanism in the gas venting circuit.

(5) In the second embodiment, the auxiliary liquid level detection circuit is provided in the reference position of the receiver, and a liquid level detection circuit is provided at the apex of the receiver. However, a configuration in which the auxiliary liquid level detection circuit is eliminated is also possible. In this configuration, the presence or absence of the liquid level will be detected with a detection method that is identical to that of the first embodiment.

INDUSTRIAL APPLICABILITY

If the present invention is used in a refrigeration device including a refrigeration circuit having a compressor and a receiver, the ability of a liquid level detection circuit to accurately determine whether or not liquid refrigerant is stored up to a predetermined position of the receiver can be improved.

What is claimed is:

1. A refrigeration device comprising:

a main refrigerant circuit including a compressor that compresses gas refrigerant, a heat source side heat exchanger, a receiver that stores liquid refrigerant, and a user side heat exchanger; and a liquid level detection circuit configured and arranged to detect if a liquid refrigerant level in the receiver is at a predetermined position by extracting a portion of refrigerant from the receiver at a predetermined level of the receiver, reducing the pressure of the portion of the refrigerant extracted, heating the refrigerant after reducing pressure of the refrigerant, measuring the temperature of the portion of the refrigerant extracted, the liquid level detection circuit having a single temperature sensor for measuring the temperature of the portion of the refrigerant extracted, and then returning the portion of the refrigerant extracted to an intake side of the compressor.

2. The refrigeration device according to claim 1, wherein the main refrigerant circuit includes a receiver arranged to store liquid refrigerant.

3. The refrigeration device according to claim 2, wherein the main refrigerant circuit uses R410A as the refrigerant.

4. The refrigeration device according to claim 1, wherein the main refrigerant circuit uses R410A as the refrigerant.

5. A refrigerant amount detection method of a refrigeration device having a main refrigerant circuit which includes a compressor that compresses gas refrigerant, a heat source side heat exchanger, and a receiver that stores liquid refrigerant; the refrigerant amount detection method comprising:

operating the a compressor of the refrigeration device to increase pressure of the refrigerant up to a pressure at which the refrigerant that flows in the refrigerant circuit can be condensed in the heat source side heat exchanger; and extracting a portion of the refrigerant in the receiver from a predetermined level of the receiver during the operating of the compressor, reducing the pressure of the portion of the refrigerant extracted from the receiver, heating the refrigerant after reducing pressure of the refrigerant, measuring refrigerant temperature of the portion of the refrigerant extracted from the receiver at a single location downstream in a refrigerant flow direction from the heating step, and determining if a liquid level in the receiver is at a predetermined position based upon the refrigerant temperature measured.

6. The refrigeration amount detection method according to claim 5, wherein R410A is used as the refrigerant in the main refrigerant circuit.

* * * * *